US010953664B2

(12) United States Patent
Fujita et al.

(10) Patent No.: US 10,953,664 B2
(45) Date of Patent: Mar. 23, 2021

(54) PRINTING APPARATUS, PRINTING METHOD, AND STORAGE MEDIUM

(71) Applicant: CANON KABUSHIKI KAISHA, Tokyo (JP)

(72) Inventors: Takashi Fujita, Kawasaki (JP); Takeru Sasaki, Kawasaki (JP); Hiroaki Ogawa, Kawasaki (JP); Okinori Tsuchiya, Yokohama (JP); Akitoshi Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/503,809

(22) Filed: Jul. 5, 2019

(65) Prior Publication Data

US 2020/0016904 A1 Jan. 16, 2020

(30) Foreign Application Priority Data

Jul. 13, 2018 (JP) ..... JP2018-133533

(51) Int. Cl.
*B41J 2/35* (2006.01)
*B41J 2/355* (2006.01)
*B41J 2/525* (2006.01)

(52) U.S. Cl.
CPC ..... *B41J 2/355* (2013.01); *B41J 2/525* (2013.01)

(58) Field of Classification Search
CPC ..... B41J 2/355; B41J 11/0045; B41J 29/393; B41J 2/32; B41J 2/525; B41J 35/16;
(Continued)

(56) References Cited

U.S. PATENT DOCUMENTS 6,195,110 B1 2/2001 Kokubo et al.
7,148,182 B2 * 12/2006 Field ..... B41M 5/136 503/201

(Continued)

FOREIGN PATENT DOCUMENTS

CN 1156668 A 8/1997
CN 1451546 A 10/2003

(Continued)

OTHER PUBLICATIONS

U.S. Appl. No. 16/429,535 to Hiroaki Ogawa, filed Jun. 3, 2019.

(Continued)

*Primary Examiner* — Kristal Feggins
(74) *Attorney, Agent, or Firm* — Venable LLP

(57) ABSTRACT

A print medium in which a plurality of color development layers that develop colors to obtain colored portions by being heated are formed at different positions in the thickness direction is conveyed in a first direction. A plurality of heat generation elements that heat the print medium are controlled so as to selectively cause the plurality of color development layers to develop the respective colors. Heating positions on the print medium are controlled such that, in at least one of the color development layers in the print medium, in a case where lines each including a plurality of pixels which are formed by the colored portions and arranged at a predetermined resolution in the first direction are arranged in a second direction, positions of the plurality of pixels are shifted between the lines in the first direction by a distance smaller than an interval corresponding to a resolution.

17 Claims, 26 Drawing Sheets

(58) Field of Classification Search
CPC .... B41J 35/18; B41J 2002/0052; B41F 16/00; B41F 16/0006
See application file for complete search history.

(56) References Cited

U.S. PATENT DOCUMENTS

| | | | | |
|---|---|---|---|---|
| 7,298,387 | B2 * | 11/2007 | Busch | B41J 2/3555 347/194 |
| 9,387,714 | B2 * | 7/2016 | Sugiyama | B41M 5/34 |
| 2003/0125206 | A1 * | 7/2003 | Bhatt | B41J 2/32 503/201 |
| 2005/0007438 | A1 | 1/2005 | Busch et al. | |
| 2005/0239650 | A1 | 10/2005 | Field et al. | |
| 2006/0290769 | A1 | 12/2006 | Liu et al. | |
| 2006/0292502 | A1 | 12/2006 | Busch et al. | |
| 2011/0069131 | A1 | 3/2011 | Tamura et al. | |
| 2013/0120769 | A1 | 5/2013 | Kakutani | |
| 2015/0343825 | A1 | 12/2015 | Sugiyama et al. | |
| 2016/0001574 | A1 | 1/2016 | Ishino et al. | |

FOREIGN PATENT DOCUMENTS

| | | | |
|---|---|---|---|
| CN | 103101320 | A | 5/2013 |
| CN | 104691107 | A | 6/2015 |
| JP | S63-25065 | A | 2/1988 |
| JP | H10-315516 | A | 12/1998 |
| JP | H10-315518 | A | 12/1998 |
| JP | 2008030486 | A | 2/2008 |
| JP | 4677431 | B2 | 4/2011 |

OTHER PUBLICATIONS

U.S. Appl. No. 16/458,604 to Okinori Tsuchiya, filed Jul. 1, 2019.
Singapore Office Action, dated Jun. 2, 2020, in corresponding Singapore Application No. 10201906334V.
Chinese Office Action, dated Dec. 3, 2020, in corresponding Chinese Application No. 201910630003.6.

* cited by examiner

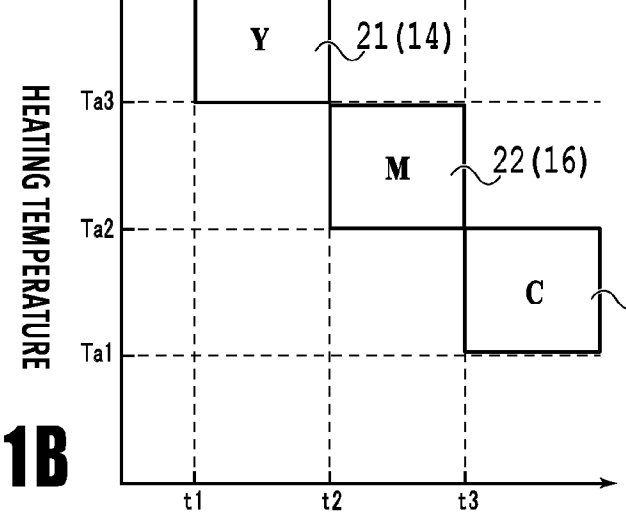
FIG.1A
FIG.1B
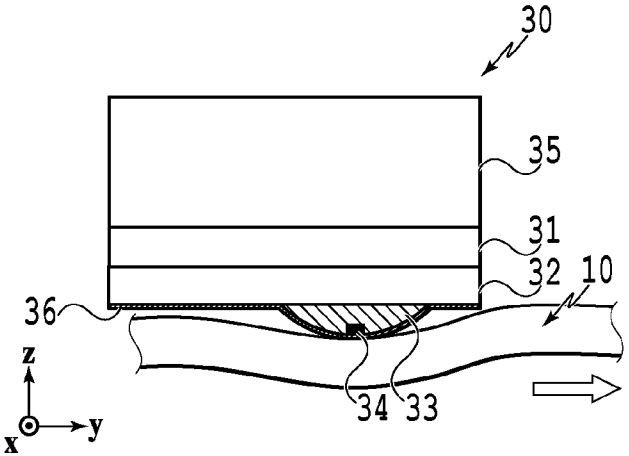
FIG.1C
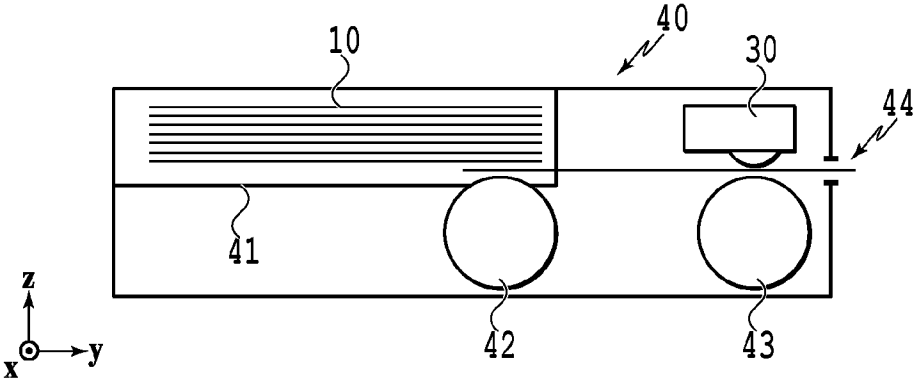
FIG.1D

PRINTING APPARATUS, PRINTING METHOD, AND STORAGE MEDIUM

BACKGROUND OF THE INVENTION

Field of the Invention

The present invention relates to a printing apparatus, a printing method, and a storage medium for printing an image by using a thermal print medium.

Description of the Related Art

The specification of Japanese Patent No. 4677431 discloses an apparatus that prints an image by using a thermally sensitive print medium including a plurality of color development layers that develop different colors. These color development layers differ from each other in the heating temperature and heating time necessary for the color development. By using these differences to selectively cause the plurality of color development layers to develop their colors, a color image can be printed.

SUMMARY OF THE INVENTION

However, in particular in a color development layer whose heating time necessary for its color development is limited to a short time, colored portions in the development layer tend to be small in area. Hence, there is a possibility that the coverage at which those colored portions cover the print medium is low and the degree of the color development thereof is lowered.

The present invention provides a printing apparatus, a printing method, and a storage medium capable of printing a high-quality image by enhancing the degree of color development of colored portions.

In the first aspect of the present invention, there is provided a printing apparatus comprising:

a conveyance unit configured to convey a print medium in a first direction;

a print head including a plurality of heat generation elements that are arranged in a second direction crossing the first direction and heat the print medium in which a plurality of color development layers that develop colors to obtain colored portions by being heated are formed at different positions in a thickness direction; and a control unit configured to control the heat generation elements on a basis of heating pulses so as to selectively cause the plurality of color development layers to develop the respective colors, the control unit controlling heating positions on the print medium to be heated by the plurality of heat generation elements such that, in at least one of the color development layers in the print medium, in a case where lines each including a plurality of pixels which are formed by the colored portions and arranged at a predetermined resolution in the first direction are arranged in the second direction, positions of the plurality of pixels are shifted between the lines in the first direction by a distance smaller than an interval corresponding to the resolution.

In the second aspect of the present invention, there is provided a printing method comprising:

a step of preparing a print medium in which a plurality of color development layers that develop colors by being heated are formed at different positions in a thickness direction;

a step of conveying the print medium in a first direction; and a step of controlling a plurality of heat generation elements that are arranged in a second direction crossing the first direction and heat the print medium, on a basis of heat generation pulses so as to selectively cause the plurality of color development layers to develop the respective colors, wherein in the controlling step, heating positions on the print medium to be heated by the plurality of heat generation elements are controlled such that, in at least one of the color development layers in the print medium, in a case where lines each including a plurality of pixels which are formed by the plurality of colored portions and arranged at a predetermined resolution in the first direction are arranged in the second direction, positions of the plurality of pixels are shifted between the lines in the first direction by a distance smaller than an interval corresponding to the resolution.

In the third aspect of the present invention, there is provided a non-transitory computer readable storage medium storing a program for causing a computer to perform a printing method, the printing method comprising:

a step of preparing a print medium in which a plurality of color development layers that develop colors by being heated are formed at different positions in a thickness direction;

a step of conveying the print medium in a first direction; and a step of controlling a plurality of heat generation elements that are arranged in a second direction crossing the first direction and heat the print medium, on a basis of heat generation pulses so as to selectively cause the plurality of color development layers to develop the respective colors, wherein in the controlling step, heating positions on the print medium to be heated by the plurality of heat generation elements are controlled such that, in at least one of the color development layers in the print medium, in a case where lines each including a plurality of pixels which are formed by the plurality of colored portions and arranged at a predetermined resolution in the first direction are arranged in the second direction, positions of the plurality of pixels are shifted between the lines in the first direction by a distance smaller than an interval corresponding to the resolution.

According to the present invention, the coverage of colored portions is increased, thereby enhancing the degree of color development thereof and thus enabling printing of a high-quality image.

Further features of the present invention will become apparent from the following description of exemplary embodiments with reference to the attached drawings.

BRIEF DESCRIPTION OF THE DRAWINGS

FIG. 1A is a cross-sectional view of an example print medium, FIG. 1B is an explanatory diagram of heating temperatures and heating times necessary for a thermal process for the print medium in FIG. 1A, FIG. 1C is an explanatory diagram of a print head in a printing apparatus in a first embodiment of the present invention, and FIG. 1D is a schematic configuration diagram of the printing apparatus in the first embodiment of the present invention;

DESCRIPTION OF THE EMBODIMENTS

Figure 2A:
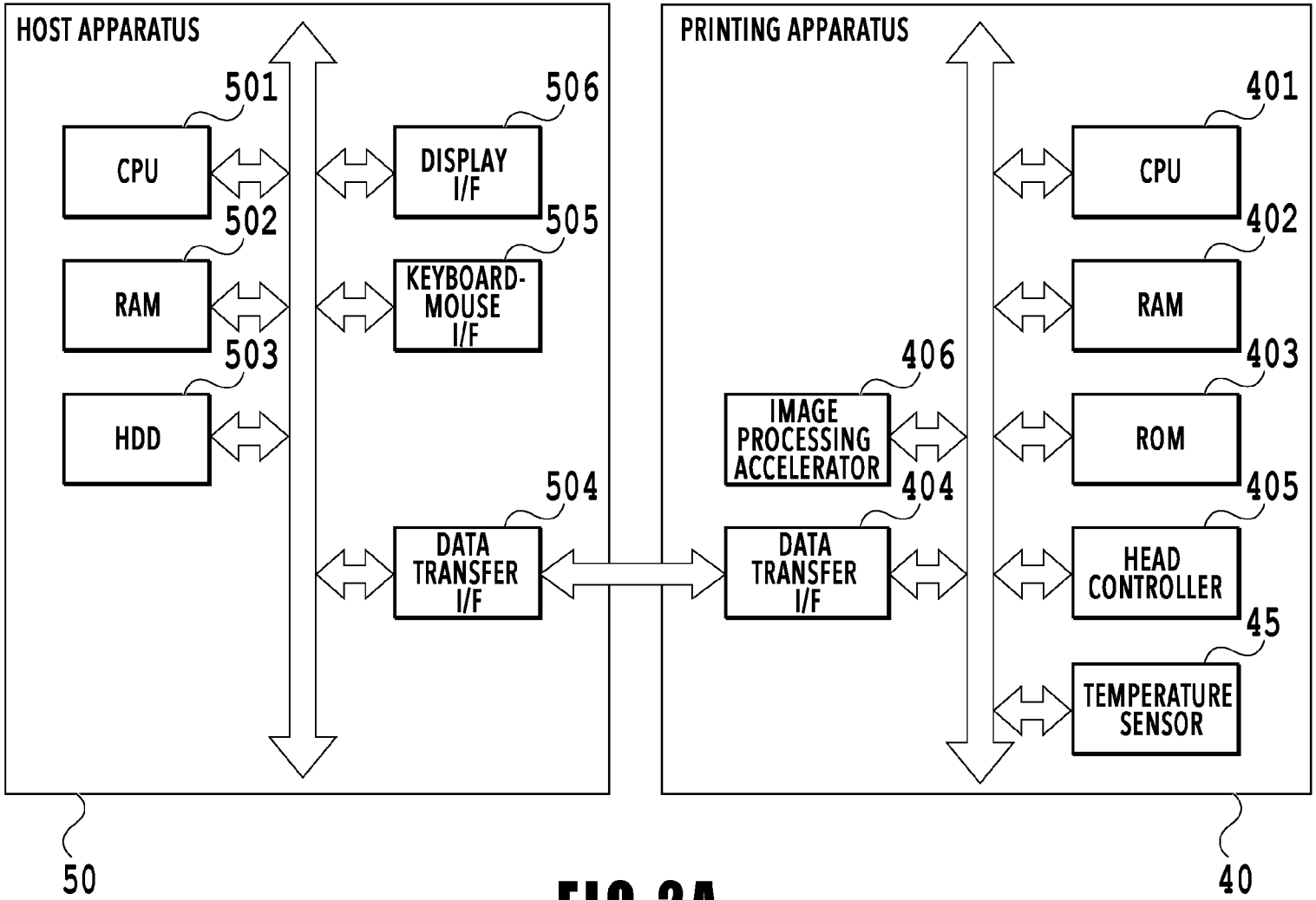
FIG. 2A is a schematic configuration diagram of a control system for the printing apparatus in FIG. 1D.

Embodiments of the present invention will be described below on the basis of the drawings.

First Embodiment

FIG. 1A is a cross-sectional view of an example of a thermal print medium 10. In the print medium 10 prepared in the present example, image forming layers 14, 16, and 18, spacer layers 15 and 17, and a protection film layer 13 are sequentially laminated on a base material 12 that reflects light. In printing a full-color image in the print medium 10, the image forming layers 14, 16, and 18 are usually yellow (Y), magenta (M), and cyan (C) color development layers. Other image forming layers may be combined.

The image forming layers 14, 16, and 18 are colorless before sensing heat, and develop their colors by being heated to the respective layer's particular activation temperatures. The order of lamination of the image forming layers 14, 16, and 18 in the print medium 10 can be selected as desired. In the case where the image forming layers 14, 16, and 18 are yellow, magenta, and cyan color development layers, an example of the order of lamination of those layers is the order illustrated in FIG. 1A. In another example of the order, the image forming layers 14, 16, and 18 are cyan, magenta, and yellow color development layers, respectively.

The spacer layer 15 is preferably thinner than the spacer layer 17, but does not have to be so if the materials of the layers 15 and 17 have substantially the same thermal diffusivity. The function of the spacer layer 17 is to control thermal diffusion in the print medium 10. In a case where the spacer layer 17 is made of the same material as the spacer layer 15, the spacer layer 17 is desirably at least four times thicker than the spacer layer 15.

All layers disposed on the base material 12 are substantially transparent before the print medium 10 senses heat. In a case where the base material 12 reflects white or the like, a color image developed in the print medium 10 is visually recognized through the protection film layer 13 against the background reflected by the base material 12. Since the layers disposed on the base material 12 are transparent, the combination of the colors developed in the image forming layers is visually recognized from the protection film layer side.

In the present example, the three image forming layers 14, 16, and 18 in the print medium 10 are disposed on a surface of the base material 12 on the same side. At least one image forming layer may be disposed on the opposite surface of the base material 12. Also, the image forming layers 14, 16, and 18 in the present example undergo a thermal process at least partly independently in accordance with two adjustable parameters (heating temperature and heating time). By adjusting these parameters, it is possible to cause desired image forming layers to develop their respective colors in accordance with the temperature and time at and for which a thermal head (print head) heats the print medium 10.

In the present example, the image forming layers 14, 16, and 18 undergo a thermal process as the print head heats the print medium 10 in contact with the protection film layer 13 in the top layer of the print medium 10. An activation temperature Ta3 at which the image forming layer 14, which is the third image forming layer from the base material 12 (the closest image forming layer to the front surface of the print medium 10), develops its color is higher than the activation temperature (Ta2) of the second image forming layer 16, which is the second image forming layer from the base material 12. Moreover, the activation temperature Ta2 of the second image forming layer 16 is higher than an activation temperature Ta1 of the first image forming layer 18 on the base material 12. The image forming layers 14, 16, and 18 are such that the farther each of the image forming layers is from the print head in contact with the protection film layer 13, the later it is heated since the heat from the print head is diffused in the spacer layer(s) and so on interposed between the image forming layer and the protection film layer 13. Although the activation temperature of an image forming layer closer to the protection film layer 13 is higher than the activation temperature of an image forming layer farther from the protection film layer 13, this delay in heating allows the former image forming layer to be activated without the latter image forming layer activated. Thus, the print medium 10 can be heated so as to activate an image forming layer at a closer position to the protection film layer 13 without activating an image forming layer at a farther position from the protection film layer 13.

Then, in a case where the print head generates heat of a relatively high temperature for a short time to activate (perform a thermal process on) the image forming layer 14, which is the closest to the protection film layer 13, the image forming layers 16 and 18 are heated only to such extents that neither of them is activated. Also, to activate the image forming layer 16 or 18, the print medium 10 may be heated with the print head for a longer time at a lower temperature than the time and the temperature for activating the image forming layer 14. Thus, it is possible to activate an image forming layer at a farther position from the protection film layer 13 without activating an image forming layer at a closer position to the protection film layer 13.

It is desirable to use a print head (thermal print head) to heat the print medium 10. However, any of various heating methods is usable as long as the heating method is capable of heating the print medium 10 in such a manner as to selectively activate the image forming layers 14, 16, and 18. For example, it is possible to employ a method using a modulated light source (means such as a laser) or the like.

FIG. 1B is an explanatory diagram of the temperatures and times of heating by the print head necessary in the thermal process for the image forming layers 14, 16, and 18. The vertical axis in FIG. 1B represents the temperature of the surface of the print medium 10 in contact with the print head, while the horizontal axis represents the heating time. Regions 21, 22, and 23 represent ranges with different combinations of temperatures and heating times. The region 21 with relatively high heating temperatures and relatively short heating times corresponds to a heating condition for activating the image forming layer (yellow (Y) color development layer) 14. The region 22 with intermediate heating temperatures and intermediate heating times corresponds to a heating condition for activating the image forming layer (magenta (M) color development layer) 16. The region 23 with relatively low heating temperatures and relatively long heating times corresponds to a heating condition for activating the image forming layer (cyan (C) color development layer) 18. The time necessary for activating the image forming layer 18 is substantially longer the time necessary for activating the image forming layer 14.

Generally, the activation temperature for activating an image forming layer is within the range of approximately 90° C. to approximately 300° C. It is preferable that the activation temperature Ta1 of the image forming layer 18 be as low as possible and preferably approximately 100° C. or higher in view of the thermal stability of the print medium 10 during shipment and storage of the print medium 10. It is preferable that the activation temperature Ta3 of the image forming layer 14 be high and preferably approximately 200° C. or higher. The activation temperature Ta2 of the image forming layer 16 is a temperature between the activation temperatures Ta1 and Ta3 and preferably between approximately 140° C. and approximately 180° C.

In the present example, the print head extends over the entire width of the print image and includes a substantially straight array of heat generation resistive elements (hereinafter referred to as "heat generation elements"). The width of the print head may be smaller than the width of the print image. In this case, for example a configuration that moves the print head or a configuration using a plurality of print heads can be used to handle the entire width of the print image. While heating pulses are applied to the heat generation elements, the print medium 10 is conveyed in a direction crossing (in the present example, perpendicular to) the line direction of the heat generation elements, so that the print medium is heated and an image is printed. The time of heating of the print medium 10 by the print head is within the range of approximately 0.001 milliseconds to approximately 100 milliseconds per print image line. The upper limit of the heating time is set on the basis of the balance between it and the time to be taken to print an image, while the lower limit is set on the basis of restrictions on the electronic circuit. The intervals of pixels (dots) forming an image are usually within a range within which 100 to 600 dots can be formed per inch in both the direction of conveyance of the print medium 10 and the direction perpendicular thereto (corresponding to a resolution of 100 to 600 dpi). The dot intervals in each direction may be different from the other.

FIG. 1C is an explanatory diagram of the positional relation between a print head 30 and the print medium 10 in the present example. Arrow x represents the direction of array of the heat generation elements in the print head 30 (line direction), arrow y represents the direction of conveyance of the print medium 10, and arrow z represents an upward direction along the vertical direction. A glaze 32 is provided on a base 31 of the print head 30, and a protruding surface glaze 33 may be provided on the glaze 32. In the case where the protruding surface glaze 33 is present, heat generation elements 34 are arranged in its surface. In the case where the protruding surface glaze 33 is not present, the heat generation elements 34 are arranged in the surface of the flat glaze 32. It is preferable to form a protection film layer 36 over the heat generation element 34, the glaze 32, and the protruding surface glaze 33. The combination of the glaze 32 and the protruding surface glaze 33, which are usually made of the same material, will also be referred to as "the glaze of the print head" below. The base 31 is in contact with a heat sink 35 and is cooled with a fan or the like. The print medium 10 comes into contact with the glaze of the print head, which is substantially longer than the length of the print medium 10 in the direction of array of the heat generation elements. A typical heat generation element measures approximately 120 micrometers in length in the direction of conveyance of the print medium 10 (y direction; first direction), and the region of thermal contact between the glaze of a general print head and the print medium 10 measures 200 micrometers or more in length in that direction.

FIG. 1D is an explanatory diagram of a schematic configuration of a printing apparatus 40 in the present example. The printing apparatus 40 comprises the print head 30, a storage unit 41 for the print medium 10, a conveyance roller 42, a platen 43, and a discharge port 44. The storage unit 41 is capable of storing a plurality of print media 10. By opening and closing a cover not illustrated, print media 10 can be refilled. During a print operation, a print medium 10 is conveyed by the conveyance roller 42 to a position facing the print head 30. After an image is printed between the print head 30 and the platen 43, the print medium 10 is discharged from the discharge port 44.

FIG. 2A is a block diagram of a printing system including the printing apparatus 40 and a personal computer (PC) 50 as a host apparatus.

A CPU 501 in the host PC 50 executes various processes by following programs stored in an HDD 503 and an RAM 502. The RAM 502 is a volatile storage and temporarily holds programs and data. The HDD 503 is a non-volatile storage and, likewise, holds programs and data. A data transfer interface (I/F) 504 controls transmission and reception of data to and from the printing apparatus 40. Wired connection such as USB, IEEE1394, or LAN or wireless connection such as Bluetooth (registered trademark) or WiFi is usable as the connection scheme for the data transmission and reception. A keyboard-mouse I/F 505 is an I/F that controls human interface devices (HIDs) such as a keyboard and a mouse, and the user can enter various pieces of information through this I/F. A display I/F 506 controls display on a display (not illustrated).

A CPU 401 in the printing apparatus 40 executes later-described processes and so on by following programs stored in an ROM 403 and an RAM 402. The RAM 402 is a volatile storage and temporarily holds programs and data. Also, the ROM 403 is a non-volatile storage and holds table data and programs to be used in the later-described processes. A data transfer I/F 404 controls transmission and reception of data to and from the PC 50. A head controller 405 controls the print head 30 on the basis of print data. Specifically, the head controller 405 reads control parameters and print data from predetermined addresses in the RAM 402. The control parameters and the print data are written by the CPU 401 to predetermined addresses in the RAM 402. In response to this write, the head controller 405 is booted and controls the print head 30. An image processing accelerator 406 is configured as hardware and executes image processing at higher speed than the CPU 401 does. Specifically, the image processing accelerator 406 reads parameters and data necessary for image processing from predetermined addresses in the RAM 402. The parameters and the data are written by the CPU 401 to predetermined addresses in the RAM 402. In response to this write, the image processing accelerator 406 is booted and executes predetermined image processing. Note that the image processing accelerator 406 does not necessarily have to be included. Depending on the printing apparatus's specifications or the like, only the CPU 401 may be used to execute a table parameter generation process, image processing, and so on.

Figure 2B:
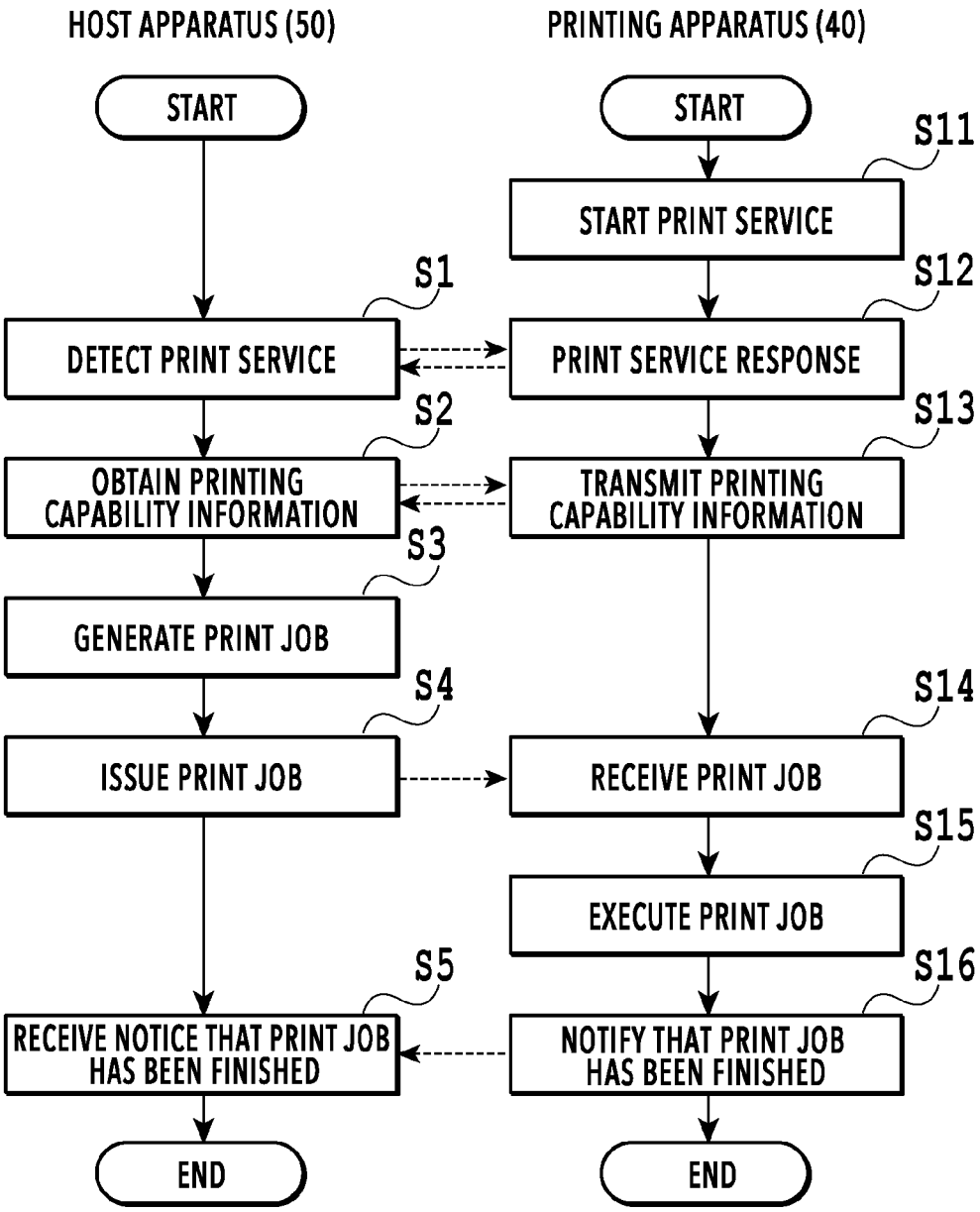
FIG. 2B is a flowchart for explaining a print operation.

FIG. 2B is a flowchart for explaining processes by the printing apparatus 40 and the host PC 50 during a print operation. In FIG. 2B, steps S1 to S5 are processes in the host PC 50, and steps S11 to S16 are processes in the printing apparatus 40.

First, in response to the user's attempt to perform printing, the printing apparatus 40 checks whether the apparatus itself is in a state where it can perform printing and, if so, starts a print service (S11). In this state, the host PC 50 detects (discovers) the print service (S1). In response to this, the printing apparatus 40 notifies the host PC 50 of information indicating that the printing apparatus 40 itself is an apparatus capable of providing the print service (printing capability information) (S12, S13).

Then, the host PC 50 obtains the printing capability information (S2). Basically, the host PC 50 requests the printing apparatus 40 to transmit the printing capability information, and the printing apparatus 40 notifies the host PC 50 of the printing capability information in response. Then, the host PC 50 creates a user interface for generating a print job on the basis of the printing capability information (S3). Specifically, on the basis of the printing capability information, the host PC 50 displays print sizes, the sizes of printable print media, and the like and also provides a suitable choice for the printing to the user.

Then, the host PC 50 issues a print job (S4), and the printing apparatus 40 receives the print job (S14) and executes the print job (S15). After completing the print job, the printing apparatus 40 notifies the host PC 50 that the print job has been finished (S16). The host PC 50 receives that notice and informs the user of the notice (S5). After the print job is finished, the host PC 50 and the printing apparatus 40 terminate the print service process.

In the present example, various information communications are each made in a manner in which the host PC 50 side sends an information transmission request to the printing apparatus 40 side and the printing apparatus 40 responds to that request. However, the method of communication between the host PC 50 and the printing apparatus 40 is not limited to this so-called pull type. For example, a so-called push-type communication method may be employed in which the printing apparatus 40 voluntarily transmits information to the host PC 50 (and other host PCs) in a network.

Figure 3:
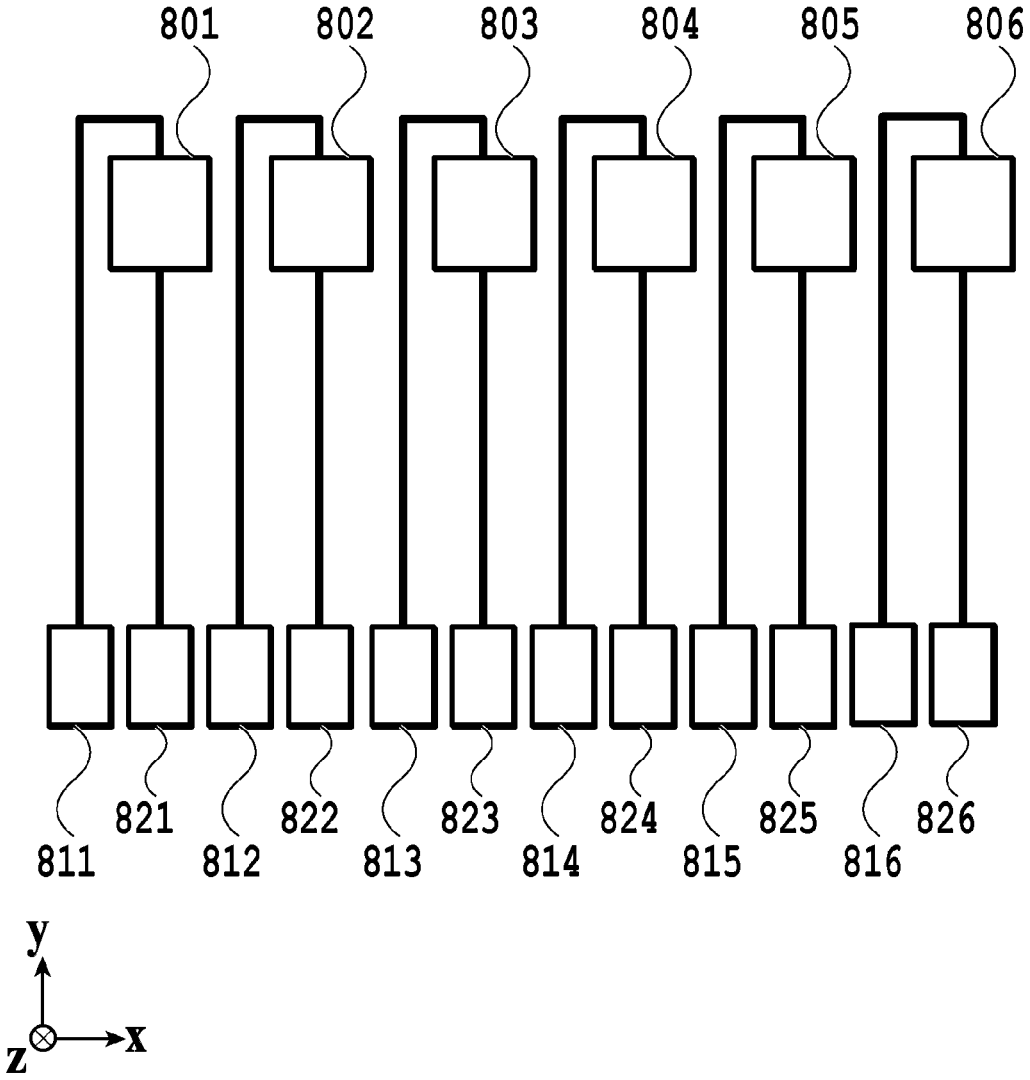
FIG. 3 is an explanatory diagram of the arrangement of heat generation elements arrangement in the print head in FIG. 1C.

FIG. 3 is an explanatory diagram of the heat generation elements 34 in the print head 30. In FIG. 3, to heat generation elements 801 to 806 (34) are connected positive electrodes 811 to 816 and negative electrodes 821 to 826 that supply electric power to them, respectively. For example, in a case where the print resolution in the width direction of the print medium (x direction; second direction) is 600 dpi, a number of heat generation elements equivalent to 1200 pixels are needed to handle a 2 inch-width print medium. In the following, the number of heat generation elements is six for convenience of description.

Figure 4:
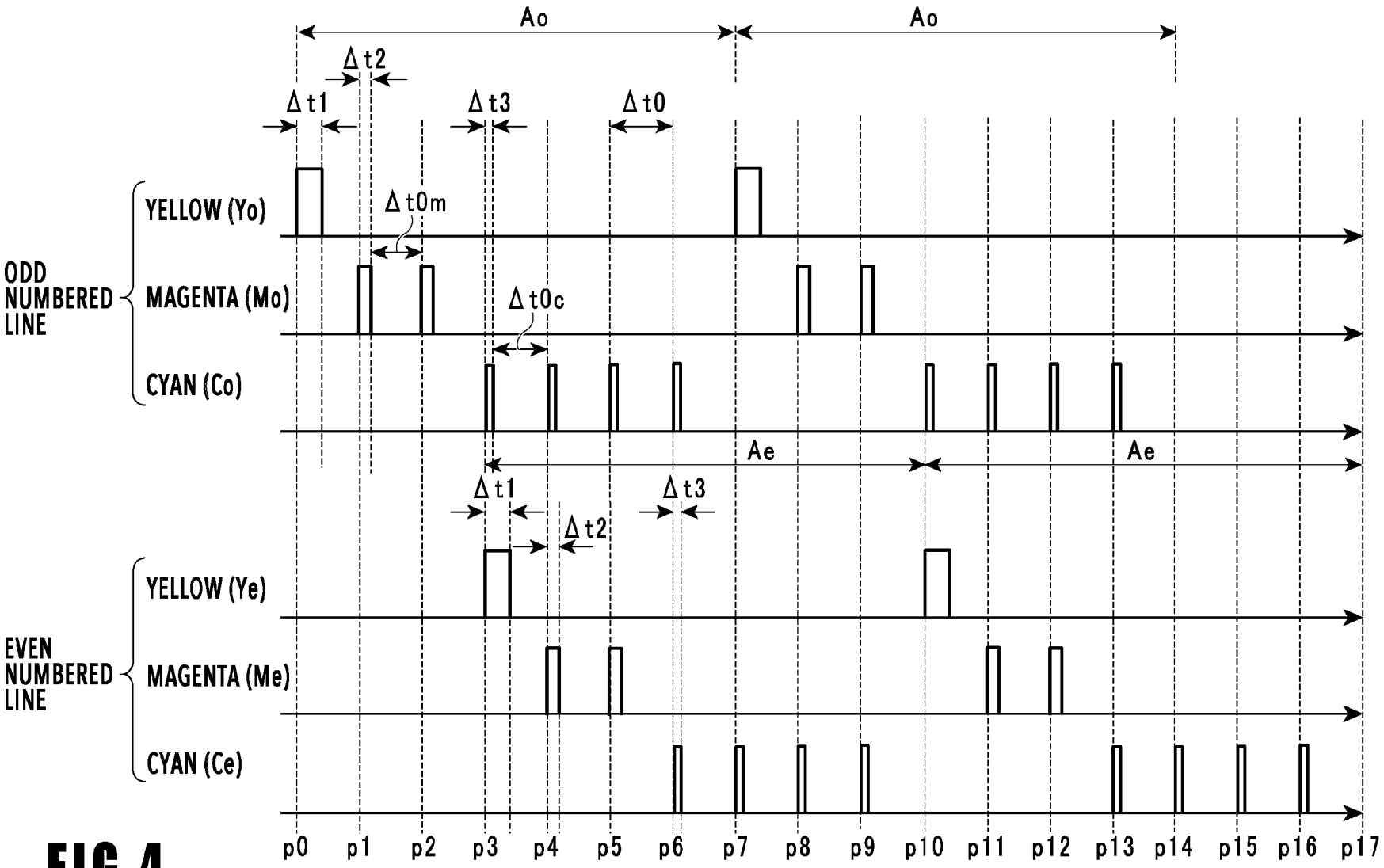
FIG. 4 is an explanatory diagram of heating pulses in the first embodiment of the present invention.

FIG. 4 is an explanatory diagram of heating pulses to be applied to the print head 30. For developing yellow (Y), the time of heating with a heating pulse (corresponding to the pulse width) is set to Δt1 so that the heating condition of the region 21 in FIG. 1B can be satisfied. Also, for developing magenta (M), heating is performed with a heating pulse for a heating time Δt2 twice in total with an interval time Δt0*m* in between so that the heating condition of the region 22 in FIG. 1B can be satisfied. Also, for developing cyan (C), heating is performed for a heating time Δt3 four times in total with an interval time Δt0*c* in between so that the heating condition of the region 23 in FIG. 1B can be satisfied.

The upper three rows in FIG. 4 (Yo, Mo, and Co) represent heating pulses to be applied to the heat generation element at any odd numbered position (such as the heat generation element 801, 803, or 805), with Yo, Mo, and Co representing heating pulses for developing yellow, magenta, and cyan, respectively. The lower three rows in FIG. 4 (Ye, Me, and Ce) represent heating pulses to be applied to the heat generation element at any even numbered position (such as the heat generation element 802, 804, or 806), with Ye, Me, and Ce representing heating pulses for developing yellow, magenta, and cyan, respectively. Red (R), green (G), blue (B), and black (K) are developed by combining yellow (Y), magenta (M), and cyan (C), as in a comparative example in FIG. 23 to be described later.

In FIG. 4, the printing of the first single pixel by the heat generation element at each odd numbered position (Yo, Mo, and Co) is executed on the basis of the heating pulses in the seven-pulse period from a point p0 to a point p7. The printing of the next single pixel is executed in the period from the point p7 to a point p14. Thus, the heat generation element (Yo, Mo, and Co) is driven to generate heat at periodic intervals of Ao, which is equal to a seven-pulse period for a single pixel, like the period from the point p0 to the point p7 and the period from the point p7 to the point p14. The distance by which the print medium moves during this single periodic interval Ao corresponds to the resolution. Also, the printing of the first single pixel by the heat generation element at each even numbered position (Ye, Me, and Ce) is executed on the basis of the heating pulses in the seven-pulse period from a point p3 to a point p10. The printing of the next single pixel is executed in the period from the point p10 to a point p17. Thus, the heat generation element (Ye, Me, and Ce) is driven to generate heat at periodic intervals of Ae, which is equal to a seven-pulse period, like the period from the point p3 to the point p10 and the period from the point p10 to the point p17. The heat generation element (Yo, Mo, and Co) and the heat generation element (Ye, Me, and Ce) are repetitively driven at periodic intervals of Ao and Ae, each of which is equal to a seven-pulse period, respectively. The periodic intervals Ae are delayed by a three-pulse period relative to the periodic intervals Ao. In other words, the timing of application of heating pulses to the heat generation element at each odd numbered position and that of the heat generation element at each even numbered position are shifted from each other by an approximately half pixel (3/7 pulse period).

Figure 5:
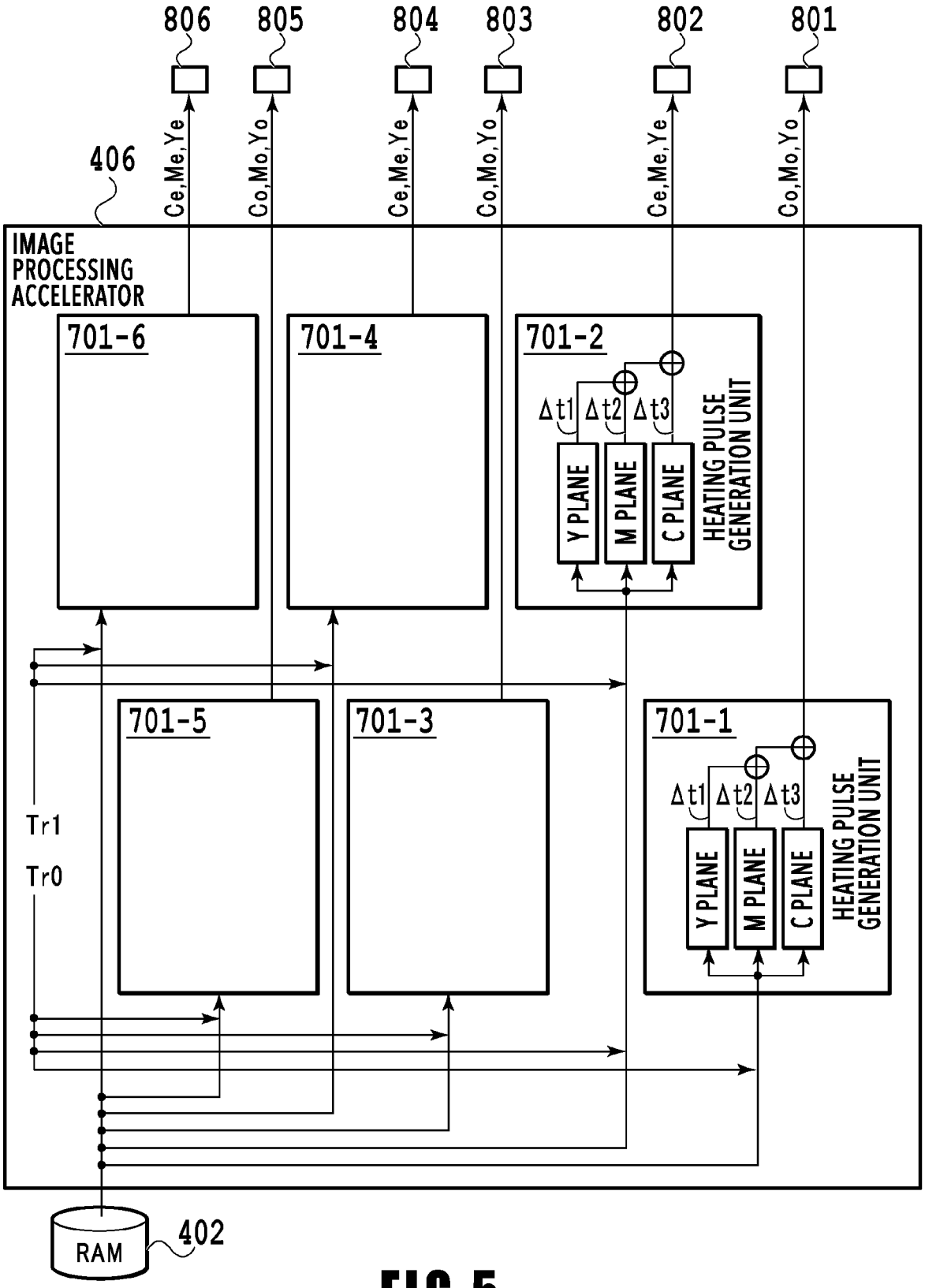
FIG. 5 is an explanatory diagram of an image processing accelerator in FIG. 2A.

FIG. 5 is a block diagram of a control system for implementing the heating pulse control in FIG. 4. Heating pulse generation units 701-1 to 701-6 in the image processing accelerator 406 in FIG. 2A correspond to the heat generation elements 801 to 806, respectively. The image processing accelerator 406 generates heating pulses to be applied to the heat generation elements on the basis of C, M, and Y components read out from the RAM 402.

Specifically, the heating pulse generation unit 701-1 reads out the C, M, and Y components of the pixel to be printed by the heat generation element 801 at an odd numbered position from the RAM 402 and generates heating pulses Co, Mo, and Yo corresponding to those components. As in FIG. 4, the heating pulse corresponding to the C component has a pulse width of Δt1 and a pulse number of 1, the heating pulse corresponding to the M component has a pulse width of Δt2 and a pulse number of 2, and the heating pulse corresponding to the Y component has a pulse width of Δt3 and a pulse number of 4. These heating pulses are applied to the heat generation element 801 in the order of Yo, Mo, and Co. In this way, the heat generation element 801 causes the target pixel to generate at least one of C, M, and Y thereby develop the desired color. Similarly, the heating pulse generation units 701-3 and 701-5 generate heating pulses Co, Mo, and Yo for their respective heat generation elements 803 and 805 at odd numbered positions and applies the heating pulses to them. The timings of application of the heating pulses to the heat generation elements 801, 803, and 805 are set on the basis of a trigger pulse Tr0, as described later. Similarly, the heating pulse generation units 701-2, 701-4, and 701-6 generate heating pulses Ce, Me, and Ye for their respective heat generation elements 802, 804, and 806 at the even numbered positions. These heating pulses are applied in the order of Ye, Me, and Ce. The timings of application of the heating pulses to the heat generation elements 802, 804, and 806 are set on the basis of a trigger pulse Tr1, as described later.

In the following, for convenience of description, the heating times Δt1, Δt2, and Δt3 have the relation expressed by the equation below, according to which the total heating pulse duration for developing each color is the same.

$$\Delta t1=\Delta t2\times 2=\Delta t3\times 4$$

Also, the heating times Δt1, Δt2, and Δt3 with the heating pulses and heating times t1, t2, and t3 in FIG. 1B have the following relations.

$$t2>\Delta t1>t1$$

$$T3>2(\Delta t2)+\Delta t0m>t2$$

$$4(\Delta t3)+3(\Delta t0c)>t3$$

The heating times taken to develop yellow (Y), magenta (M), and cyan (C) have the following relation.

$$Y<M<C$$

During the interval times Δt0*m* and Δt0*c*, the temperature of the print medium 10 drops due to transfer of heat to the glaze, the base 31, and the heat sink 35 (see FIG. 1C) of the print head 30. Also, during the interval times Δt0*m* and Δt0*c*, the heat in the print medium 10 also transfers to the platen 43 (see FIG. 1D) and so on, due to which the temperature of the print medium 10 drops as well. Thus, assuming that the amounts of energy introduced by the heating pulses for developing yellow (Y), magenta (M), and cyan (C) are equal, the peak temperatures for developing these colors (peak temperatures for Y, M, and C) have the relation expressed by the inequality below.

$$Y>M>C$$

Also, the peak temperatures for Y, M, and C satisfying the heating conditions in FIG. 1B have the relations expressed by the inequalities below.

$$\text{Peak temperature for } Y>Ta3$$

$$Ta3>\text{peak temperature for } M>Ta2$$

$$Ta2>\text{peak temperature for } C>Ta1$$

By controlling the peak temperatures for Y, M, and C as described above, the colors of Y, M, and C are developed independently of each other.

Figure 6:
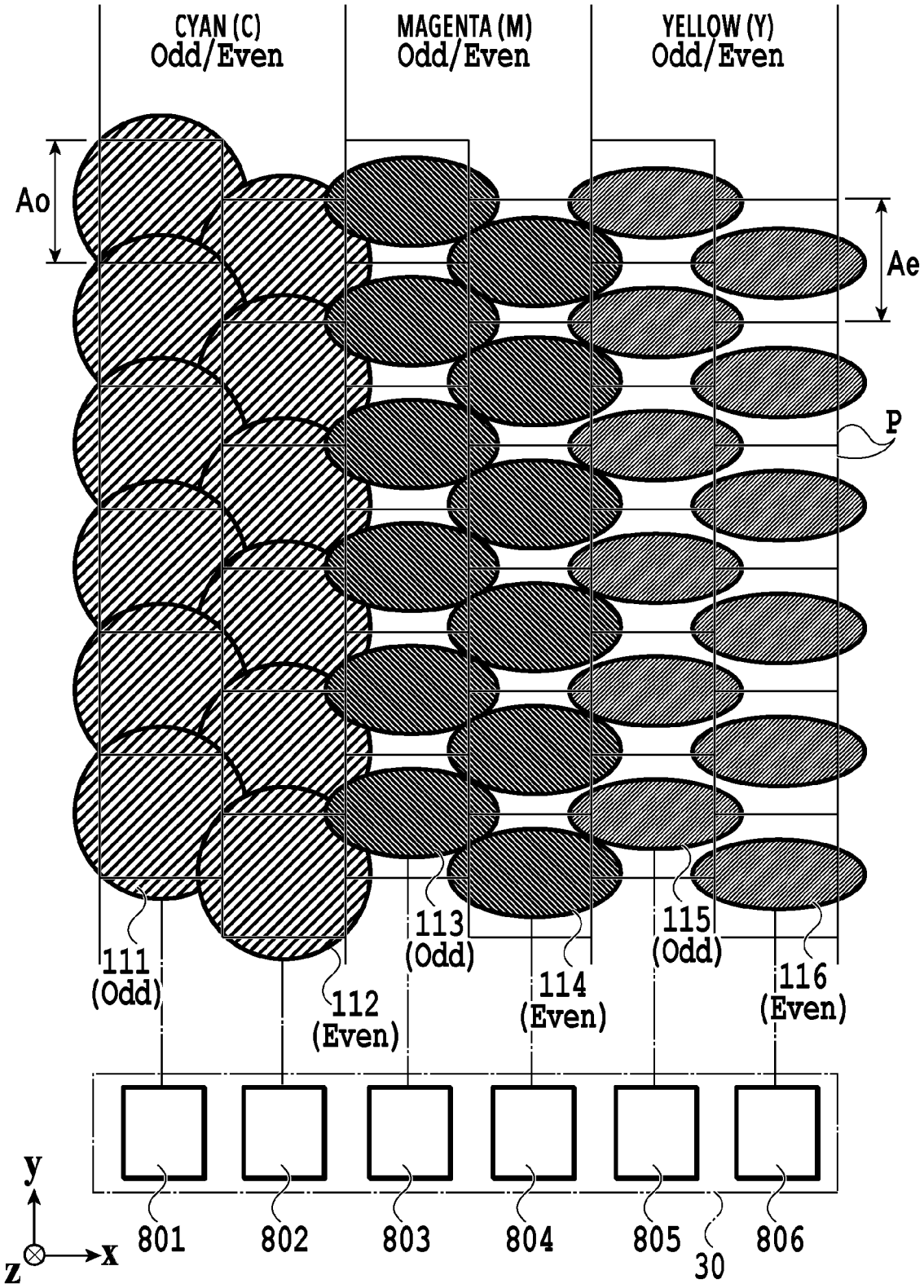
FIG. 6 is an explanatory diagram of the arrangement of colored portions caused to develop colors by the heating pulses in FIG. 4.

FIG. 6 is an explanatory diagram of colored portions in the print medium 10 caused to develop colors by applying the heating pulses in FIG. 4 to the heat generation elements 801 to 806 of the print head 30 in FIG. 3. The heat generation elements 801 to 806 and pixel lines 111 to 116 extending in the direction of conveyance of the print medium 10 (y direction) are associated with each other, respectively, in order to cause the pixel lines 111 and 112, the pixel lines 113 and 114, and the pixel lines 115 and 116 to develop cyan (C), magenta (M), and yellow (Y) at predetermined resolutions, respectively. The pixel lines 111, 113, and 115 are odd numbered lines (Odd), and the pixel lines 112, 114, and 116 are even numbered lines (Even).

As mentioned above, the periodic drive intervals Ae for the heat generation element (Ce) for the even numbered pixel line 112 is delayed by a three-pulse period (3/7 pulse period) relative to the periodic drive intervals Ao for the heat generation element (Co) for the odd numbered pixel line 111. Thus, the cyan (C) colored portion at the pixel line 112 is shifted from the cyan (C) colored portion at the pixel line 111 by an approximately half pixel toward the upstream side in the direction of conveyance (y direction). In other words, the cyan (C) colored portion at the pixel line 112 is shifted from the cyan (C) colored portion at the pixel line 111 by a length smaller than each resolution toward the upstream side in the direction of conveyance (y direction). Similarly, the magenta (M) colored portion at the pixel line 114 is shifted from the magenta (M) colored portion at the pixel line 113 by an approximately half pixel toward the upstream side in the direction of conveyance. Also, the yellow (Y) colored portion at the pixel line 116 is shifted from the yellow (Y) colored portion at the pixel line 115 by an approximately half pixel toward the upstream side in the direction of conveyance. As described above, the heating positions on the print medium to be heated by the heat generation elements are controlled such that the positions of colored portions adjacent to each other in the x direction (second direction) in the same color development layer are shifted from each other in the y direction (first direction).

The coverage at which a magenta (M) or yellow (Y) colored portion covers the print medium 10 is lower than the coverage of a cyan (C) colored portion. This is because, as mentioned above, the heating times taken to develop yellow (Y), magenta (M), and cyan (C) have the relation described below.

$$Y<M<C$$

Figure 25:
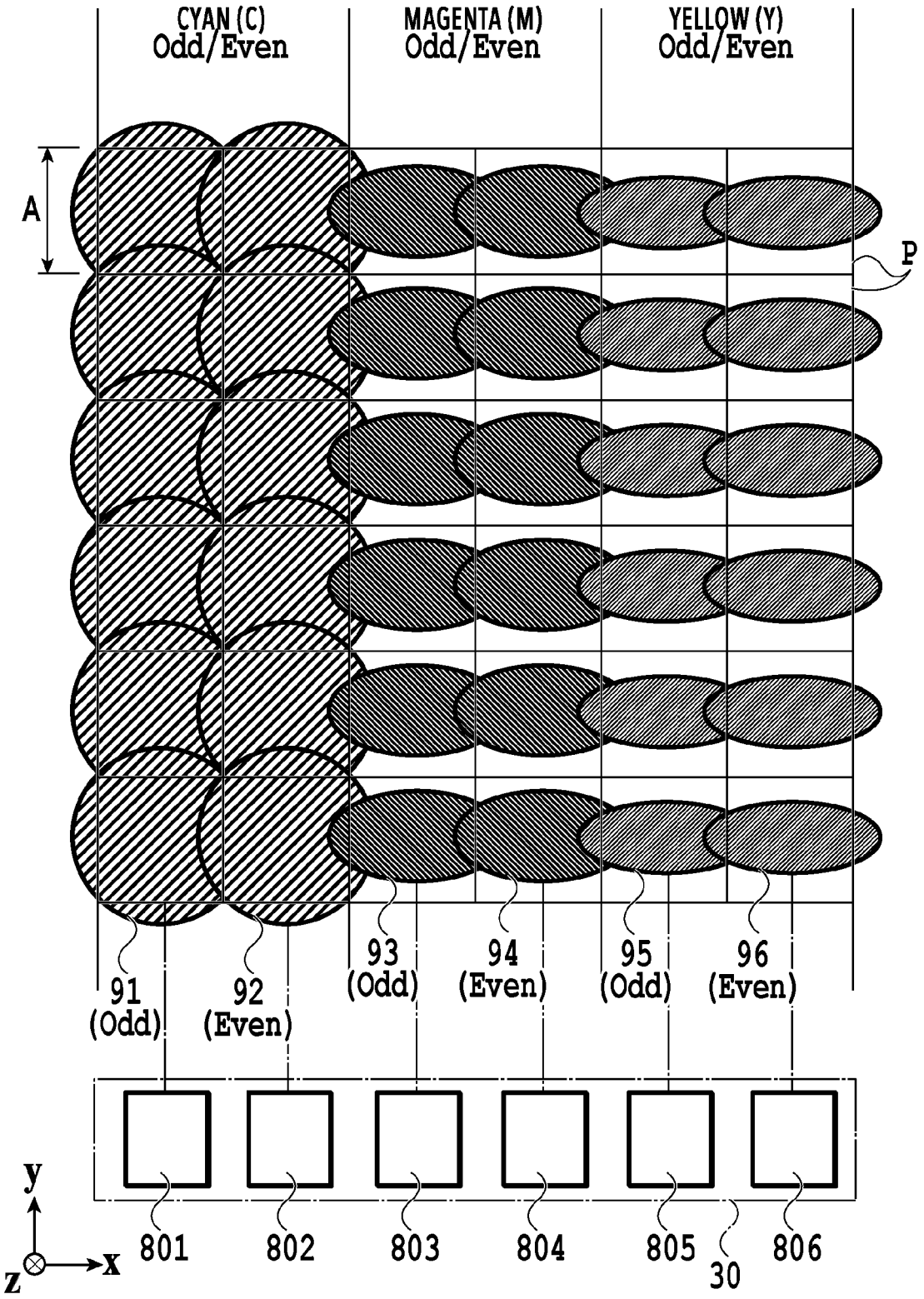
FIG. 25 is an explanatory diagram of the arrangement of colored portions caused to develop colors by the heating pulses in FIG. 23.

In FIG. 6, the coverage of the magenta (M) colored portions at the pixel lines 113 and 114 is higher than the coverage of the magenta (M) colored portions at pixel lines 93 and 94 in the later-described comparative example of FIG. 25. Similarly, the coverage of the yellow (Y) colored portions at the pixel lines 115 and 116 is higher than the coverage of the yellow (Y) colored portions at pixel lines 95 and 96 in the later-described comparative example. This is because, in the present example, the periodic drive intervals Ao for the heat generation element for each odd numbered pixel line and the periodic drive intervals Ae for the heat generation element for each even numbered pixel line are shifted from each other by an approximately half pixel (3/7 pulse period). More specifically, the distance between the centers of adjacent pixels is approximately 1.15 times ($2\div\sqrt{3}$) longer than that in the later-described comparative example of FIG. 25, thereby making it harder for the colored portions to overlap each other.

In FIG. 6, each rectangle frame portion P represents a single pixel, and the length of each single pixel in the width direction of the print medium (x direction) corresponds to a single heat generation element, while the length in the direction of conveyance of the print medium (y direction) corresponds to a periodic drive interval Ao or Ae, which is equal to a seven-pulse period. In the present embodiment, the periodic drive intervals Ao and Ae for the heat generation elements at the odd and even numbered positions are shifted from each other, so that the corresponding pixels P are shifted from each other as well. Accordingly, the distance between the centers of the adjacent pixels P is longer than that in the later-described comparative example of FIG. 25, thereby making it harder for the colored portions to overlap each other.

As described above, in the present embodiment, it is made harder for colored portions in the print medium 10 to overlap each other, so that their coverages are increased and accordingly the degree of the color development is enhanced. This enables printing of a high-quality image.

Comparative Example

Figure 23:
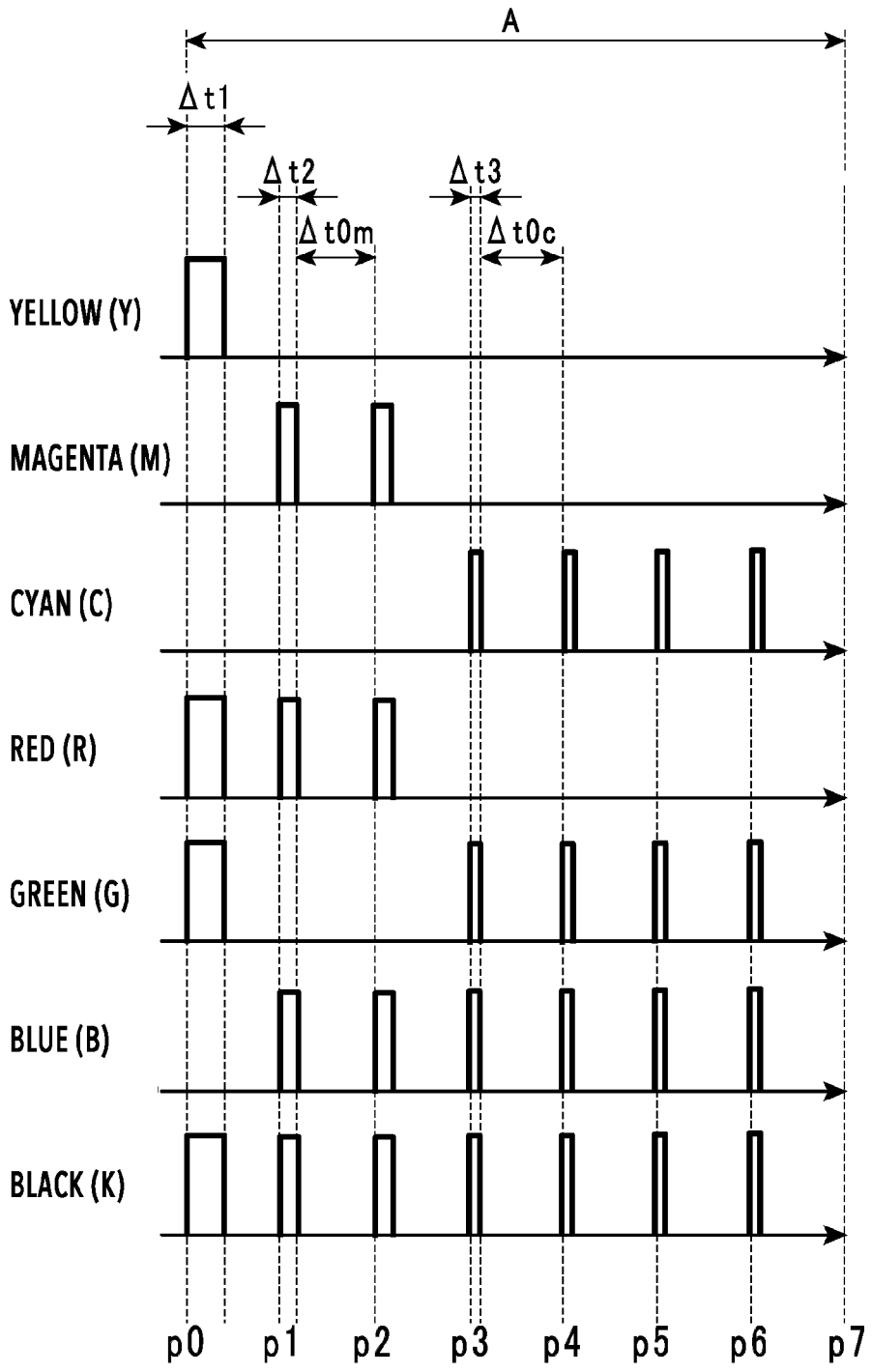
FIG. 23 is an explanatory diagram of heating pulses in a comparative example of the present invention.

FIG. 23 is an explanatory diagram of a comparative example of heating pulses to be applied to the print head 30. The heating times Δt1, Δt2, and Δt3 and the interval times Δt0*m* and Δt0*c* in FIG. 23 are the same as those in the above-described example of FIG. 5. Unlike the embodiment of the present invention, the plurality of heat generation elements in this comparative example are driven without being divided into a plurality of groups (a group for the heat generation elements at the odd numbered positions and a group for the heat generation elements at the even numbered positions). Thus, the heating pulses for driving the heat generation elements are different from those in the embodiment of the present invention.

As illustrated in FIG. 23, to develop red (R), the heating pulses are controlled so as to develop yellow (Y) and magenta (M) in this order. To develop green (G), the heating pulses are controlled so as to develop yellow (Y) and cyan (C) in this order. Also, to develop blue (B), the heating pulses are controlled so as to develop magenta (M) and cyan (C) in this order. Also, to develop black (K), the heating pulses are controlled so as to develop yellow (Y), magenta (M), and cyan (C) in this order.

Figure 24:
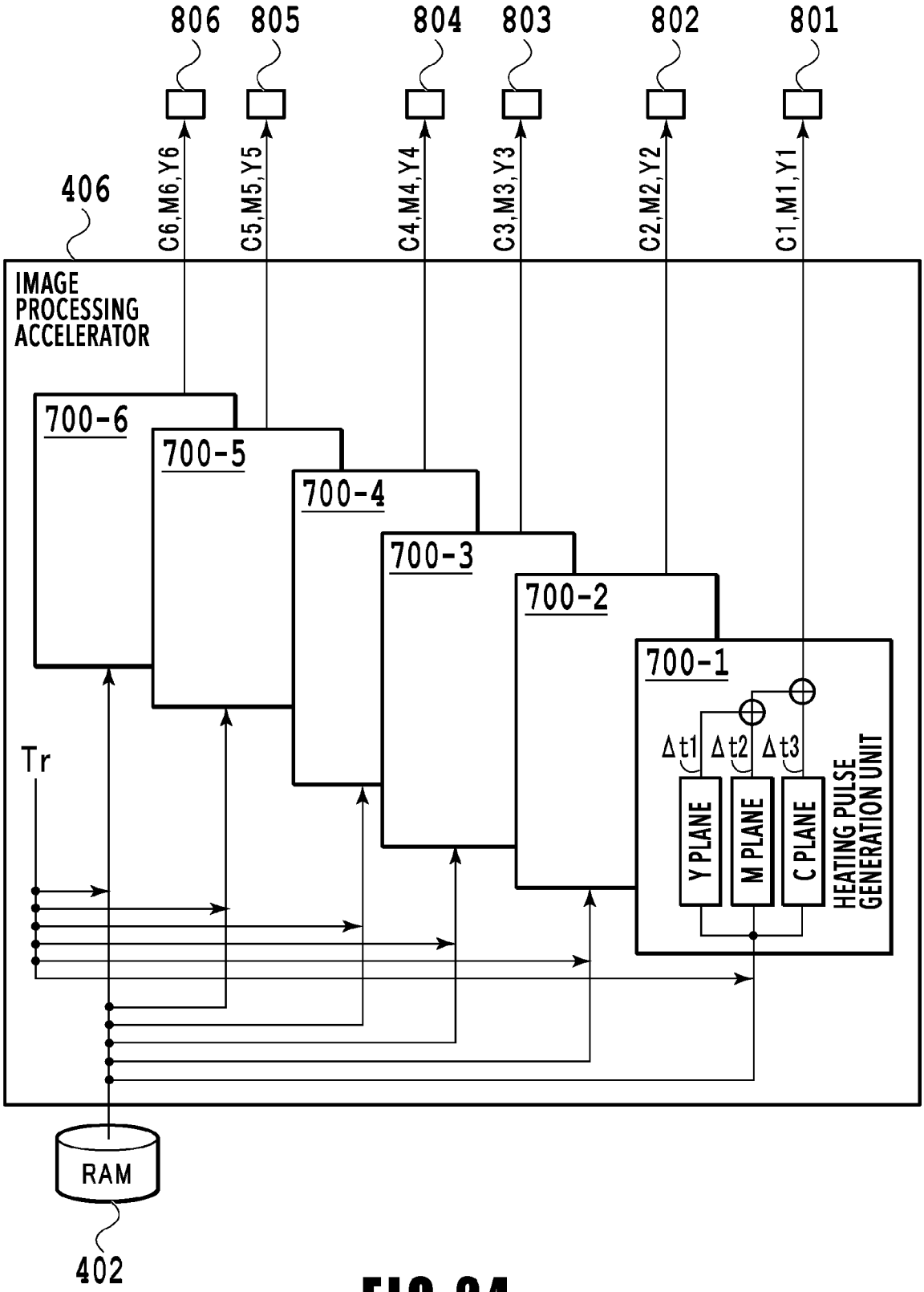
FIG. 24 is an explanatory diagram of an image processing accelerator in the comparative example of the present invention.

FIG. 24 is a block diagram of a control system for implementing the heating pulse control in the comparative example of FIG. 23. The heat generation elements 801 to 806 and heating pulse generation unit 700-1 to 700-6 in the image processing accelerator 406 correspond to each other, respectively. The image processing accelerator 406 generates heating pulses to be applied to the heat generation elements on the basis of C, M, and Y components read out from the RAM 402.

Specifically, the heating pulse generation unit 700-1 firstly reads out the C, M, and Y components of the pixel to be printed by the heat generation element 801 from the RAM 402 and generates heating pulses C1, M1, and Y1 corresponding to those C, M, and Y components on the basis of those components. These heating pulses are applied to the heat generation element 801 in the order of Y1, M1, and C1. In this way, the heat generation element 801 causes the target pixel to develop at least one of C, M, and Y to thereby develop the desired color. The application timings for the heating pulses (P0 to P6) are set on the basis of a trigger pulse Tr. Similarly, the heating pulse generation units 700-2 to 700-6 generate heating pulses to be applied to their respective heat generation elements 802 to 806.

As mentioned above, the coverage at which a magenta (M) or yellow (Y) colored portion covers the surface of the print medium 10 is lower than the coverage of a cyan (C) colored portion. Moreover, in this comparative example, the plurality of heat generation elements are driven without being divided into a plurality of groups. Thus, as illustrated in FIG. 25, the magenta (M) colored portions overlap each other, and the cyan (C) colored portions overlap each other as well. This makes the coverages of magenta (M) and cyan (C) even lower, so that the degree of the color development thereof is low. Accordingly, the image quality may possibly be deteriorated.

(Image Processing)

Figure 7:
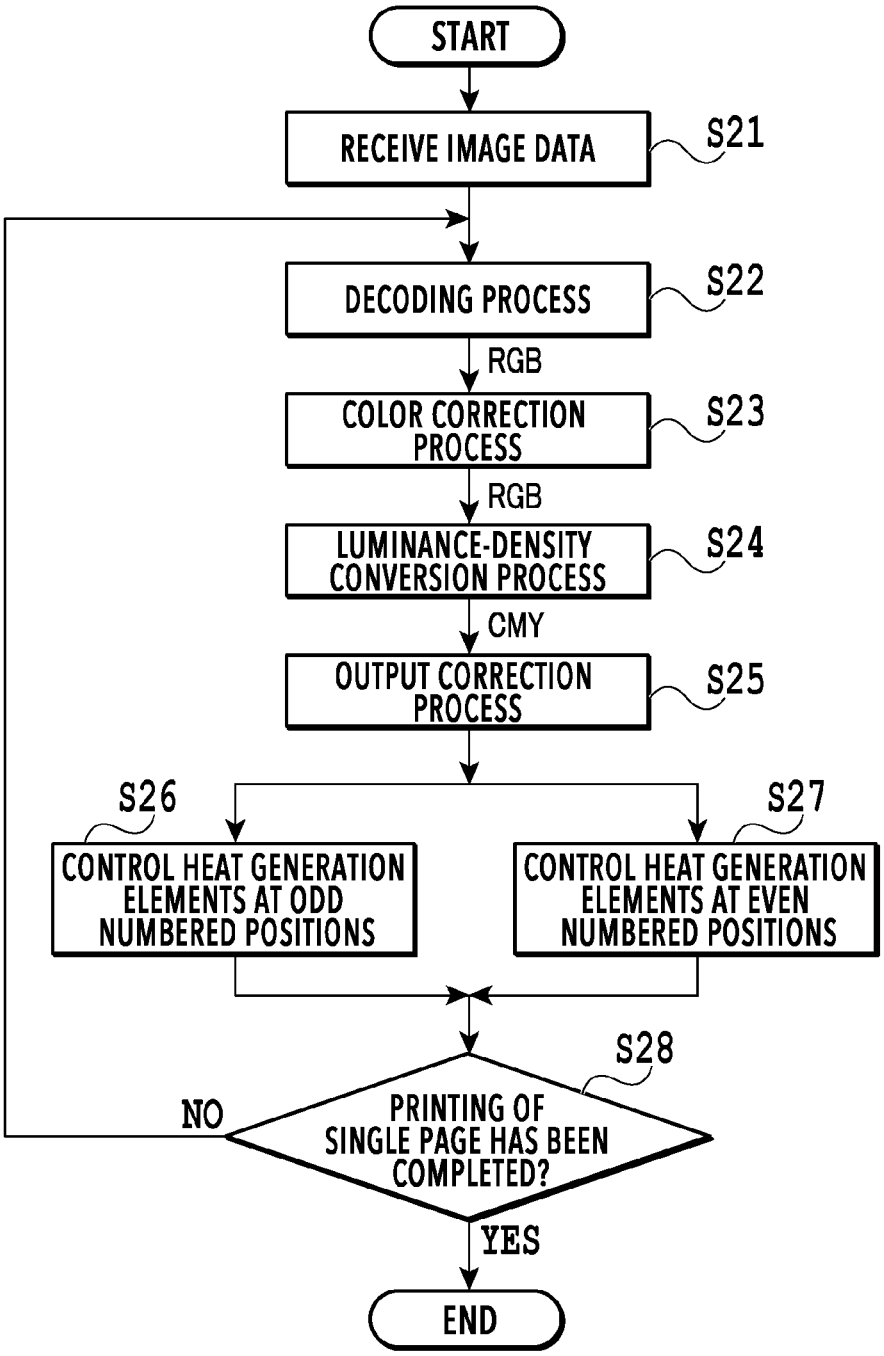
FIG. 7 is a flowchart for explaining image processing in the first embodiment of the present invention.

FIG. 7 is a flowchart of image processing for implementing a print operation in the present embodiment. The processing in FIG. 7 corresponds to the print job execution process in S15 of FIG. 2B and is executed by the CPU 401 or the image processing accelerator 406 of the printing apparatus 40 (see FIG. 2A). The symbol "S" in FIG. 7 means a step.

First, the CPU 401 or the accelerator 406 receives the image data in the print job received in S14 of FIG. 2B (S21) and decodes the image data in a case where it has been compressed or encoded (S22). Generally, the image data at this point is RGB data. The type of the RGB data is preferably a standard color information, such as sRGB or adobe RGB. In the present example, the image data contains 8-bit information for each color and its value range is 0 to 255. Data containing information with other number of bits, such as 16 bits, may be used as the image data.

Then, the CPU 401 or the accelerator 406 performs a color correction process on the image data (S23). While this process can be performed on the host PC 50 side in FIG. 2A, it is preferable to perform it in the printing apparatus 40 in a case of performing color correction suitable for the printing apparatus 40. Generally, the image data at this point is RGB data, and this RGB image data is of a type of RGB dedicated for the printing apparatus 40, or so-called device RGB.

Then, the CPU 401 or the accelerator 406 performs luminance-density conversion process (S24). General thermal printing apparatuses (thermal printers) convert RGB image data into image data of cyan (C), magenta (M), and yellow (Y) as below.

$$C=255-R$$

$$M=255-G$$

$$Y=255-B$$

In the pulse control in the present example, for instance, a magenta parameter for developing magenta (M) as a single color and a magenta parameter for developing red (R) as a secondary color are different. Then, in order to individually set these parameters, it is desirable to perform a luminance-density conversion process using a three-dimensional lookup table as below.

$$C=3D_LUT[R][G][B][0]$$

$$M=3D_LUT[R][G][B][1]$$

$$Y=3D_LUT[R][G][B][2]$$

The three-dimensional lookup table (3D_LUT) in the present example is formed of 50331648 (=256×256×256×3) data tables. The data in these tables corresponds to data of the pulse widths of heating pulses to be applied from the point p0 to the point p7 in FIG. 4. However, in order to reduce the amount of data, 14739 (17×17×17×3) data tables may be used by reducing the number of grids from 256 to 17, and a result may be calculated by interpolation computation. The number of grids may be set as appropriate, such as 16 grids, 9 grids, or 8 grids. Also, as for the interpolation method in the interpolation computation, any method can be used such as a known tetrahedral interpolation. Similarly, it is possible to independently set a yellow parameter for developing red (R), a cyan parameter and a yellow parameter for developing green (G), a magenta parameter and a cyan parameter for developing blue (B). It is also possible to independently set a yellow parameter, a magenta parameter, and a cyan parameter for developing black (K).

After this luminance-density conversion process (S24), the CPU 401 or the accelerator 406 performs an output correction process (S25). First, as described below, the CPU 401 or the accelerator 406 calculates each of pulse widths c, m, and y for achieving the densities of development of cyan (C), magenta (M), and yellow (Y) by using a one-dimensional lookup table (1D_LUT).

$$c=1D_LUT[C]$$

$$m=1D_LUT[M]$$

$$y=1D_LUT[Y]$$

The maximum value of the pulse width c is Δt3 in FIG. 4, the maximum value of the pulse width m is Δt2 in FIG. 4, and the maximum value of the pulse width y is Δt1 in FIG. 4. The printing apparatus 40 in the present example modulates the intensity of the color development in the print medium 10 by pulse width modulation. In other words, a desired tone is achieved by making the pulse widths c, m, and y smaller than their respective maximum pulse widths. A known method can be used for this process.

Further in the present example, the temperature of the print medium 10 is obtained using a temperature sensor 45 and the heating pulses to be applied to the print head 30 are modulated on the basis of the obtained temperature. Specifically, the pulse widths of heating pulses necessary for the image forming layers to reach their respective activation temperatures are controlled such that the higher the obtained temperature, the shorter the pulse widths. A known method can be used for this process. Also, instead of using the temperature sensor 45 or the like to directly obtain the temperature of the print medium 10, the CPU 501 of the host apparatus 50 (see FIG. 2A) may estimate the temperature of the print medium 10, and the pulse widths of the heating pulses may be controlled on the basis of the estimated temperature. A known method can be used as the method of estimating the temperature of the printing medium 10.

In a case where the temperature of the print medium 10 is a predetermined allowable temperature or higher, it is preferable to make the print operation stand by or suspend the print operation and to start or resume the print operation after the temperature of the print medium 10 drops to below the predetermined allowable temperature. Also, if a print operation for a single page of print medium 10 is made to stand by in the middle of the print operation, it is not easy to match the image density before the print operation is made to stand by and the image density after the print operation is resumed. For this reason, whether or not to make the print operation stand by is determined in S21. Making a print operation standby and resuming the print operation are preferably done on a per page basis.

Then, the CPU 401 or the accelerator 406 applies heating pulses to the heat generation elements for the odd numbered pixel lines (the heat generation elements at the odd numbered positions) (S26). Specifically, from the point p0 to the point p7 in FIG. 4, the CPU 401 or the accelerator 406 applies a heating pulse with a pulse width yo, heating pulses with a pulse width mo, and heating pulses with a pulse width co to the heat generation elements at the odd numbered positions. With FIG. 4, the CPU 401 or the accelerator 406 applies a heating pulse with the pulse width yo to the heat generation element 805 at the point p0, applies a heating pulse with the pulse width mo to the heat generation element 803 at the points p1 and p2, and applies a heating pulse with the pulse width co to the heat generation element 801 at the points p3, p4, p5, and p6. The pulse widths yo, mo, and co are the pulse widths of the heating pulses to be applied to the heat generation elements for the odd numbered pixel lines among the pulse widths y, m, and c, generated in S25.

In parallel with this process in S26, the CPU 401 or the accelerator 406 applies heating pulses to the heat generation elements for the even numbered pixel lines (the heat generation elements at the even numbered positions) (S27). With FIG. 4, the CPU 401 or the accelerator 406 applies a heating pulse with a pulse width ye to the heat generation element 806 at the point p3, applies a heating pulse with a pulse width me to the heat generation element 804 at the points p4 and p5, and applies a heating pulse with a pulse width ce to the heat generation element 802 at the points p6, p'7, P8, and P9. The pulse widths ye, me, and ce are the pulse widths of the heating pulses to be applied to the heat generation elements for the even numbered pixel lines among the pulse widths y, m, and c, generated in S25.

In the present example, as in FIG. 4, when the first heating pulse for the heat generation element (Co) at an odd numbered position is applied in the periodic drive interval Ao for the first single pixel (point p3), a heating pulse is applied to the heat generation element (Ye) at an even numbered position in the periodic drive interval Ae for the first single pixel. Also, when the second heating pulse for the heat generation element (Ce) at an even numbered position is applied in the periodic drive interval Ae for the first single pixel (point p7), a heating pulse is applied to the heat generation element (Yo) at an odd numbered position in the periodic drive interval Ao (p7 to p13) for the next single pixel. For this reason, it is necessary to perform control such that heating pulses are applied to the print head 30 after determining the heating pulses for at least two adjacent pixels in the direction of conveyance (y direction) in advance.

Then, the CPU 401 or the accelerator 406 determines whether the printing of the single page of print medium 10 has been completed (S28), and repeats the processes in S22 to S27 until the printing of the single page is completed. If the printing of the single page is completed, the CPU 401 or the accelerator 406 terminates the process in FIG. 7.

As described above, in the present embodiment, the timings of application of heating pulses to the heat generation elements at the odd and even numbered positions are shifted from each other by an approximately half pixel (3/7 pulse period). This increases the coverage of each colored portion and thus enables printing of a high-quality image. Also, in a case of driving N heat generation elements for N pixels (including heat generation elements at odd and even numbered positions), the highest electric power for simultaneously driving a plurality of heat generation elements is an electric power equivalent to $\{(\Delta t1+\Delta t3)\times N/2\}$ at the point p7 in FIG. 4. On the other hand, in the comparative example of FIG. 23, the highest electric power for simultaneously driving a plurality of heat generation elements is an electric power equivalent to $(\Delta t1\times N)$ at the point p0. In the present embodiment, since $\Delta t1>\Delta t3$, the highest electric power for simultaneously driving a plurality of heat generation elements is lower. Accordingly, the maximum electric capacity of an AC power supply or battery can be reduced.

Meanwhile, to increase the coverage of each colored portion, it is effective to set the amount of shift between the color development positions to an approximately half pixel (3/7 pulse period), as in the present embodiment. However, the amount of shift may be less than an approximately half pixel. Also, the amount of shift between the color development positions is not limited to a value set in increments of a single pulse, such as a 3/7 pulse, but may be set in increments of a 0.5 pulse, for example.

Second Embodiment

Figure 8:
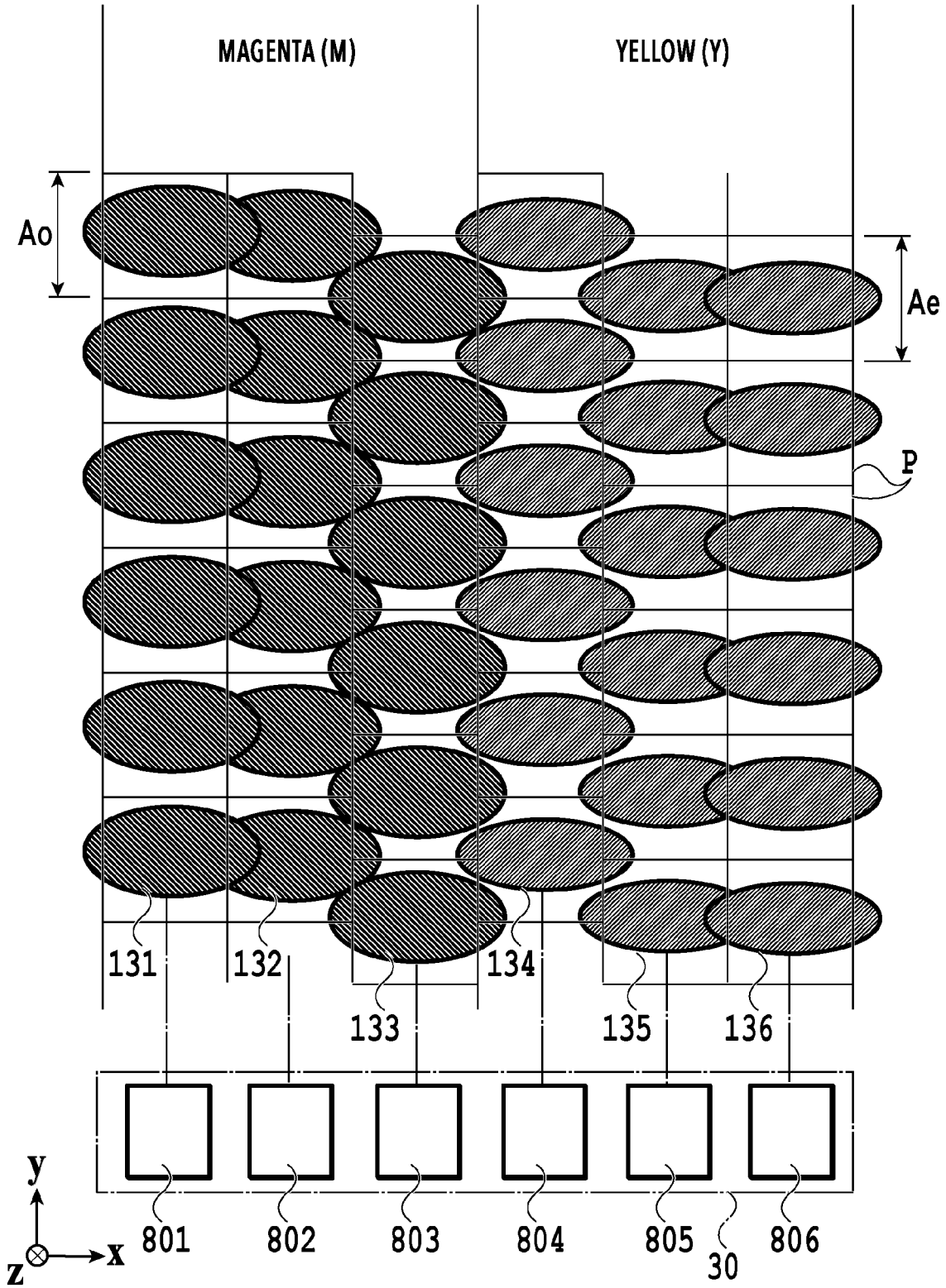
FIG. 8 is an explanatory diagram of the arrangement of colored portions in a second embodiment of the present invention.

FIG. 8 is an explanatory diagram of colored portions in a second embodiment of the present invention. In the present example, the heat generation elements 801 to 806 are driven to generate heat on the basis of heating pulses so as to cause pixel lines 131 to 133 to develop magenta (M) and cause pixel lines 134 to 136 to develop yellow (Y).

The pixel lines 131 and 132 are caused to develop magenta (M) with the same timing as the pixel line 113 in FIG. 6 in the foregoing embodiment, while the pixel line 133 is caused to develop magenta (M) with the same timing as the pixel line 114 in FIG. 6. Also, the pixel line 134 is caused to develop yellow (Y) with the same timing as the pixel line 115 in FIG. 6, while the pixel lines 135 and 136 are caused to develop yellow (Y) with the same timing as the pixel line 116 in FIG. 6. The heating pulses are set to achieve the color development with these timings. In the present example, image processing similar to the image processing in FIG. 7 in the foregoing embodiment can be performed. In this case, the heat generation elements for the pixel lines 131, 132, and 134 may be controlled in S26, while the heat generation elements for the pixel lines 133, 135, and 136 may be controlled in S27.

In the present example, as for the color development positions (pixel positions) for magenta (M), the color development positions at the two pixel lines 131 and 132 are the normal position, while the color development position at the pixel line 133 is shifted by an approximately half pixel. Also, as for the color development positions (pixel positions) for yellow (Y), the color development position at the single pixel line 134 is the normal position, while the color development positions at the two pixel lines 135 and 136 are shifted by an approximately half pixel. The color development positions for magenta (M) and yellow (Y) are purposely shifted in this manner. In this manner, in a case of developing a secondary color (e.g., red (R)) by causing the pixel lines to develop both magenta (M) and yellow (Y), the colored portions have higher coverages, thereby making the uncolored regions in the print medium 10 smaller. This enables printing of a high-quality image.

Meanwhile, the combination of the number of pixel lines to be caused to develop the same color and the color development positions at these pixel lines is not limited to the example of FIG. 8. For example, the number of pixel lines to be caused to develop the same color may be four, and the color development positions at two pixel lines among the four may be the normal position while the color development positions at the other two pixel lines may be shifted. Alternatively, the number of pixel lines to be caused to develop the same color may be eight, and the color development positions at four pixel lines among the eight may be the normal position while the color development positions at the other four pixel lines may be shifted. Moreover, such a combination for each color may be varied from the other's to reduce synchronization between the colors. This suppresses generation of moire.

Third Embodiment

In the first embodiment, it is necessary to perform control to associate a plurality of pixels (two pixels in the example mentioned earlier) with each other, as mentioned earlier, so that the drive timing for the group of heat generation elements at the odd numbered positions and the drive timing for the group of heat generation elements at the even numbered positions can be shifted from each other by an approximately half pixel (3/7 pulse period). In the present embodiment, such control to associate a plurality of pixels is not necessary.

Figure 9:
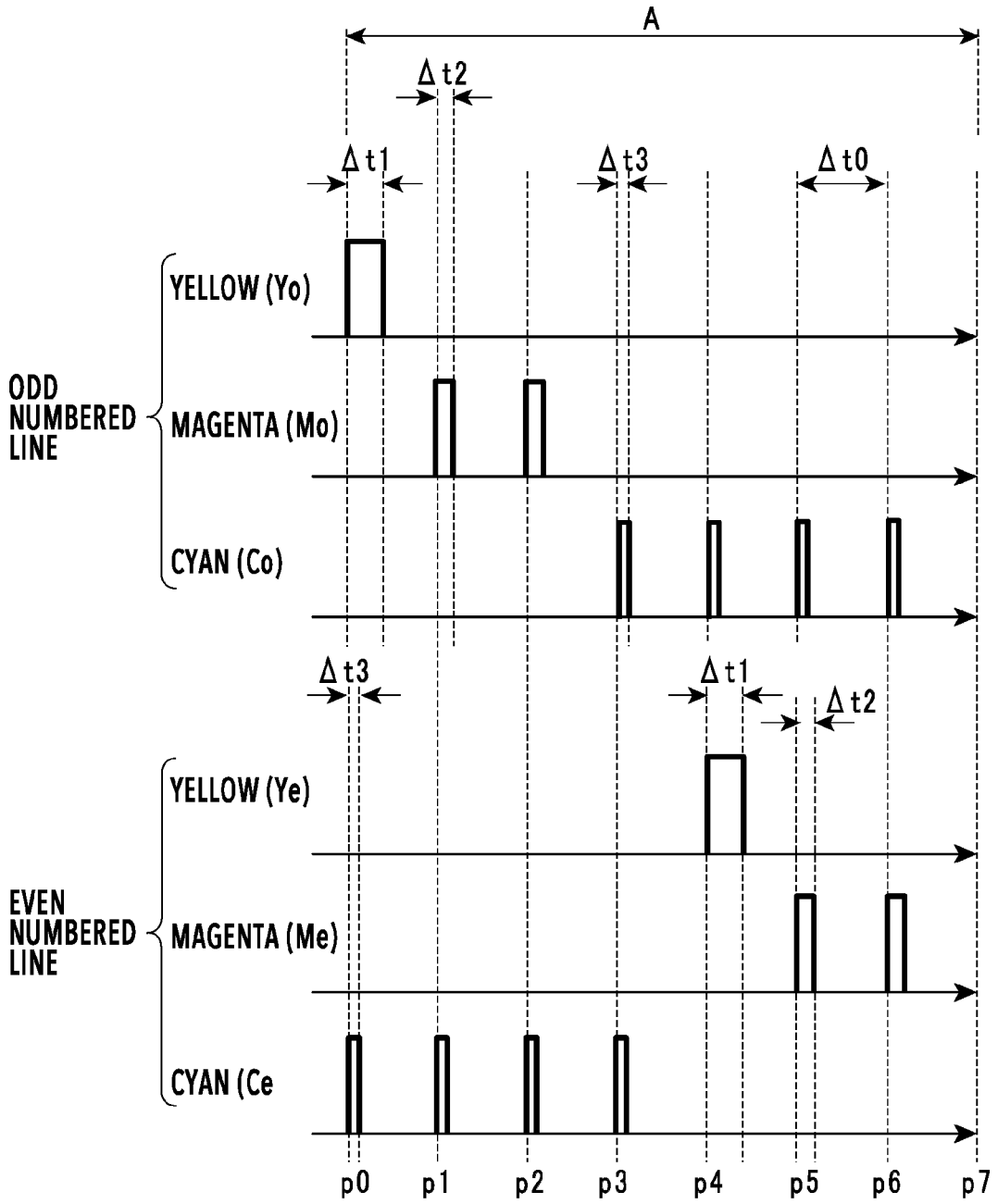
FIG. 9 is an explanatory diagram of heating pulses in a third embodiment of the present invention.

FIG. 9 is an explanatory diagram of heating pulses in the present embodiment. In FIG. 9, the upper three rows (Yo, Mo, and Co) represent heating pulses to be applied to the heat generation element at any odd numbered position (801, 803, and 805). Also, the lower three rows (Ye, Me, and Ce) represent heating pulses to be applied to the heat generation element at any even numbered position (802, 804, and 806). The heating pulses for the heat generation element at the odd numbered position are applied in the order of yellow (Yo), magenta (Mo), and cyan (Co). On the other hand, the heating pulses for the heat generation element at the even numbered position are applied in the order of cyan (Ce), yellow (Ye), and magenta (Me). Thus, in the present embodiment, the order of driving of the heat generation elements at the odd numbered positions and the order of driving of the heat generation elements at the even numbered even numbered positions are varied from each other within a single periodic drive interval A, instead of shifting the periodic drive intervals Ao and Ae for the heat generation elements at the odd and even numbered positions from each other, as in the first embodiment.

As a result, the heat generation element (Ye) is driven with a delay of an approximately half pixel (4/7 pulse period) relative to the heat generation element (Yo), and the heat generation element (Me) is driven with a delay of an approximately half pixel (4/7 pulse period) relative to the heat generation element (Mo). Also, the heat generation element (Co) is driven with a delay of an approximately half pixel (4/7 pulse period) relative to the heat generation element (Ce). Since the orders of driving of the heat generation elements at the odd and even numbered positions are shifted from each other as above within a single periodic drive interval A, control to associate a plurality of pixels as in the foregoing first embodiment is not necessary.

Figure 10:
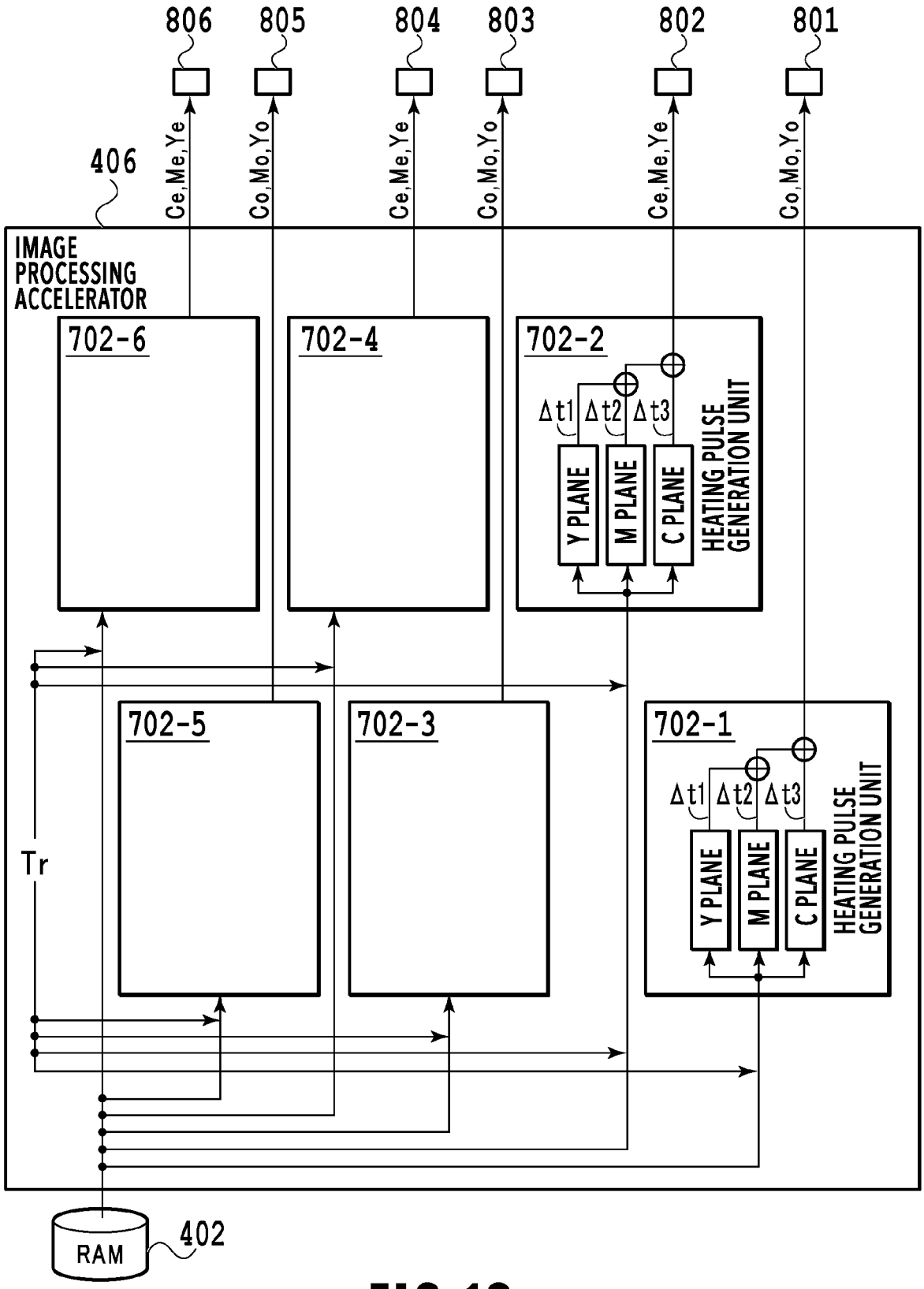
FIG. 10 is an explanatory diagram of an image processing accelerator in the third embodiment of the present invention.

FIG. 10 is a block diagram of a control system for implementing the heating pulse control in FIG. 9.

Heating pulse generation units 702-1 to 702-6 in the image processing accelerator 406 correspond to the heat generation elements 801 to 806, respectively, and generate heating pulses on the basis of C, M, and Y components read out from the RAM 402. Specifically, the heating pulse generation unit 702-1 reads out the C, M, and Y components of the pixel to be printed by the heat generation element 801 at an odd numbered position from the RAM 402 and generates heating pulses Co, Mo, and Yo corresponding to those components. These heating pulses are applied to the heat generation element 801 in the order of Yo, Mo, and Co. Similarly, the heating pulse generation units 702-3 and 702-5 generate heating pulses Co, Mo, and Yo for their respective heat generation elements 803 and 805 at odd numbered positions and apply the heating pulses to them. Also, the heating pulse generation units 702-2, 702-4, and 702-6 generate heating pulses Ce, Me, and Ye for their respective heat generation elements 802, 804, and 806 at the even numbered positions and apply these heating pulses in the order of Ce, Me, and Ye. The timings of application of the heating pulses to the heat generation elements 801 to 806 are set on the basis of a trigger pulse Tr1.

Figure 11:
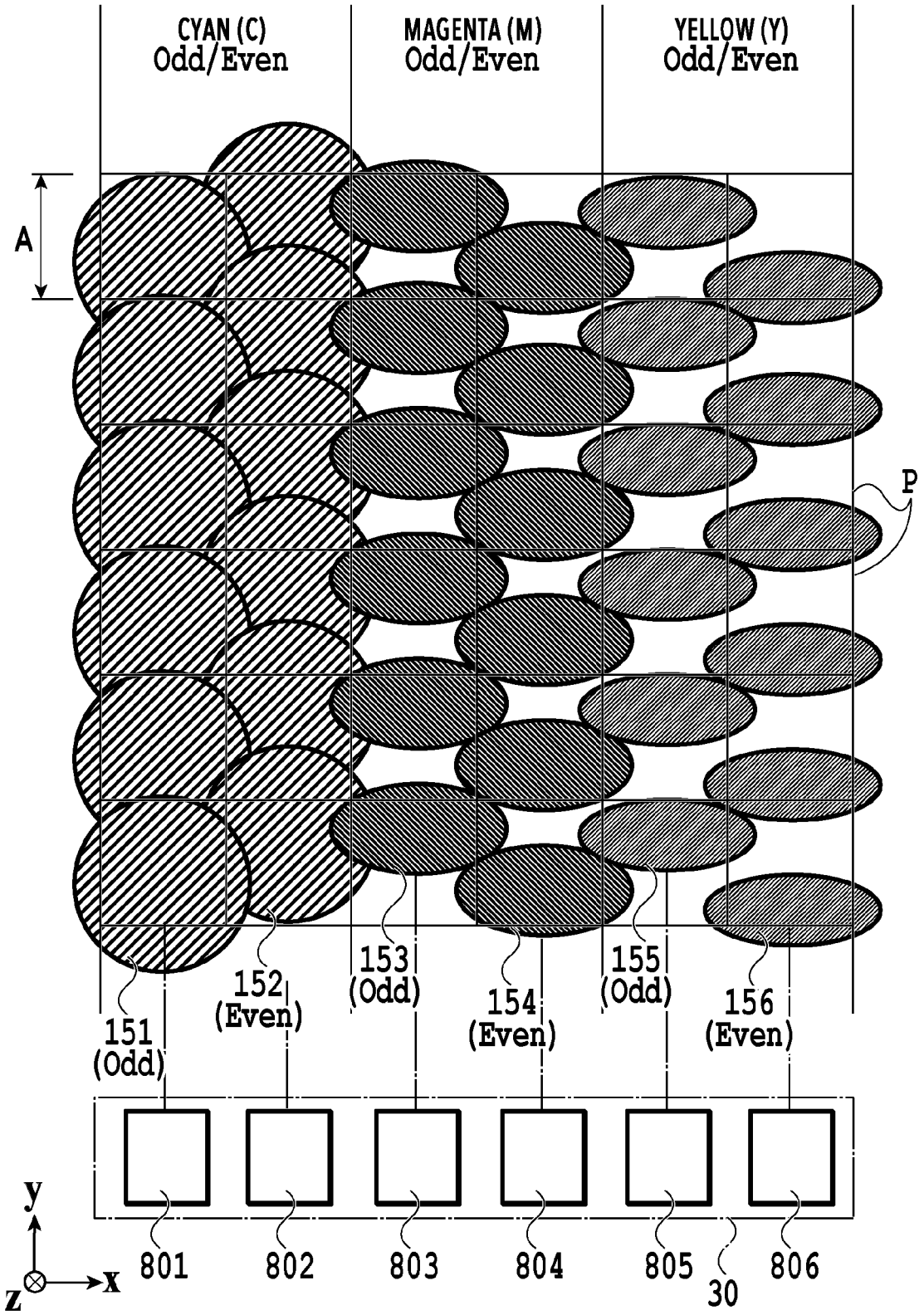
FIG. 11 is an explanatory diagram of the arrangement of colored portions caused to develop colors by the heating pulses in FIG. 9.

FIG. 11 is an explanatory diagram of colored portions in the print medium 10 caused to develop colors by applying the heating pulses in FIG. 9 to the heat generation elements 801 to 806 of the print head 30 in FIG. 10. As in FIG. 6 in the foregoing first embodiment, it is made harder for colored portions in the print medium 10 to overlap each other, so that their coverages are increased and accordingly the degree of the color development is enhanced. This enables printing of a high-quality image.

Figure 12:
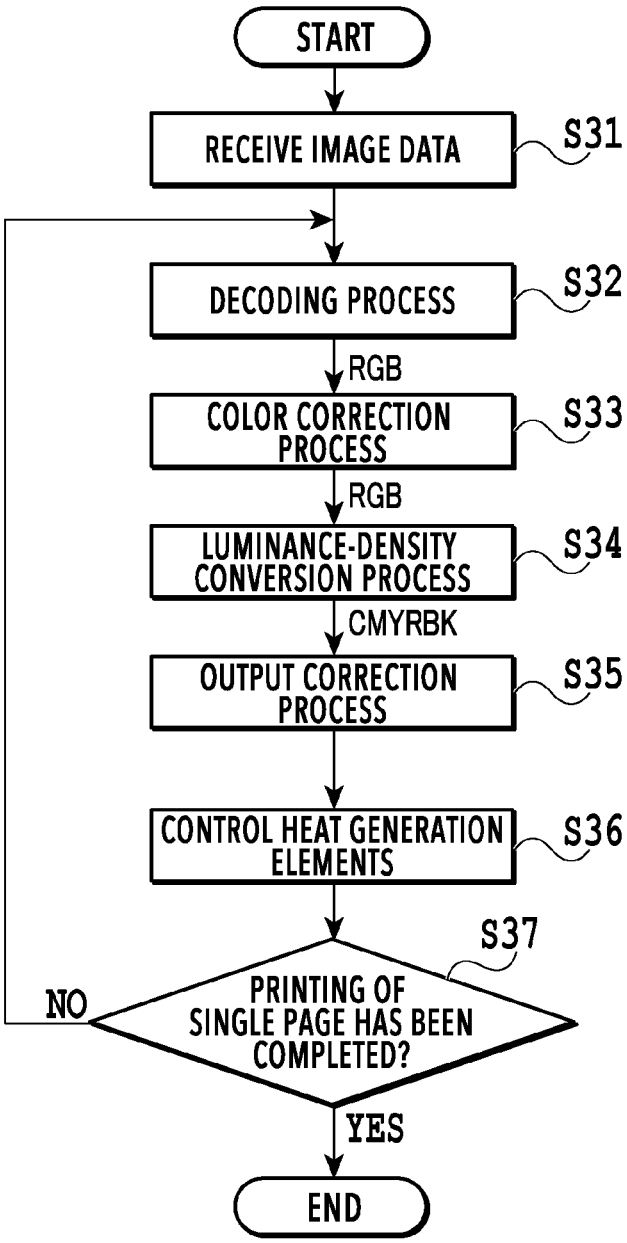
FIG. 12 is a flowchart for explaining image processing in the third embodiment of the present invention.

FIG. 12 is a flowchart of image processing for implementing a print operation based on the heating pulses in the present embodiment. The processing in FIG. 12 corresponds to the print job execution process in S15 of FIG. 2B and is executed by the CPU 401 or the image processing accelerator 406 of the printing apparatus 40 (see FIG. 2A). S31 to S35 in FIG. 12 are the same as S21 to S25 in FIG. 7 and description thereof is therefore omitted.

In S36, the CPU 401 or the accelerator 406 applies heating pulses to the heat generation elements at the odd and even numbered positions. With FIG. 11, the CPU 401 or the accelerator 406 applies heating pulses with the pulse widths yo and ce to the heat generation elements 805 and 802, respectively, at the point p0, and applies heating pulses with the pulse widths mo and ce to the heat generation elements 803 and 802, respectively, at the points p1 and p2. Further, the CPU 401 or the accelerator 406 applies heating pulses with the pulse widths co and ce to the heat generation elements 801 and 802, respectively, at the point p3, and applies heating pulses with the pulse widths co and ye to the heat generation elements 801 and 806, respectively, at the point p4. Also, the CPU 401 or the accelerator 406 applies heating pulses with the pulse widths co and me to the heat generation elements 801 and 804, respectively, at the points p5 and p6. Among the pulse widths y, m, and c, generated in S35, the pulse widths of the heating pulses applied to the heat generation elements at the odd numbered positions are yo, mo, and co, and the pulse widths of the heating pulses applied to the heat generation elements at the even numbered positions are ye, me, and ce.

Then, the CPU 401 or the accelerator 406 determines whether the printing of the single page of print medium 10 has been completed (S37), and repeats the processes in S32 to S36 until the printing of the single page is completed. If the printing of the single page is completed, the CPU 401 or the accelerator 406 terminates the process in FIG. 12.

As described above, in the present embodiment, the drive timings for the heat generation elements at the odd and even numbered positions are varied from each other within a single periodic drive interval for a heat generation element. This increases the coverage of each colored portion and thus enables printing of a high-quality image, and also eliminates the need for control to associate a plurality of pixels. In addition, as in the foregoing first embodiment, the highest electric power for simultaneously driving a plurality of heat generation elements is lower.

Fourth Embodiment

In the present embodiment, the plurality of heat generation elements are divided into a number of groups larger than two groups for the heat generation elements at the odd and even numbered positions to control the directionalities of arrangement of colored portions in the print medium so as to improve the robustness against displacement of the colored portions.

Figure 13:
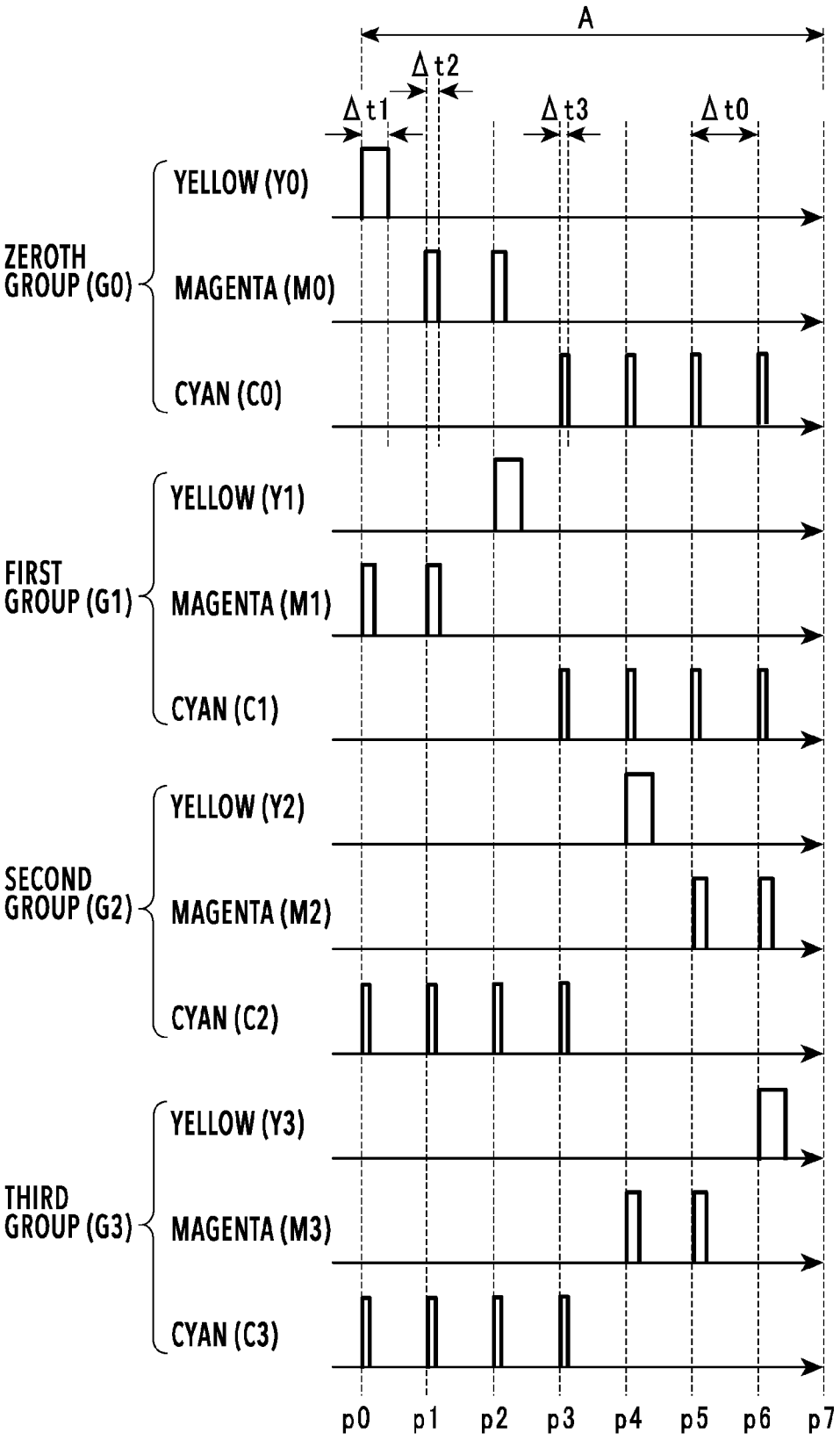
FIG. 13 is an explanatory diagram of heating pulses in a fourth embodiment of the present invention.

FIG. 13 is an explanatory diagram of heating pulses in the present embodiment. In the present example, the plurality of heat generation elements are divided into four, zeroth to third groups G0 to G3 and their drive is controlled. The heating pulses for the heat generation elements in the zeroth group G0 are denoted as Y0, M0, and C0, and the heating pulses for the heat generation elements in the first group G1 are denoted as Y1, M1, and C1. Similarly, the heating pulses for the heat generation elements in the second group G2 are denoted as Y2, M2, and C2, and the heating pulses for the heat generation elements in the third group G3 are denoted as Y3, M3, and C3.

The plurality of heat generation elements are divided into four groups as group G0, group G1, group G2, group G3, group G0, . . . along the direction in which they are arranged. Specifically, in the print head 30 in FIG. 3, the heat generation element 801 is classified as the group G0, the heat generation element 802 is classified as the group G1, the heat generation element 803 is classified as the group G2, the heat generation element 804 is classified as the group G3, the heat generation element 805 is classified as the group G0, and the heat generation element 806 is classified as the group G1.

Figure 14:
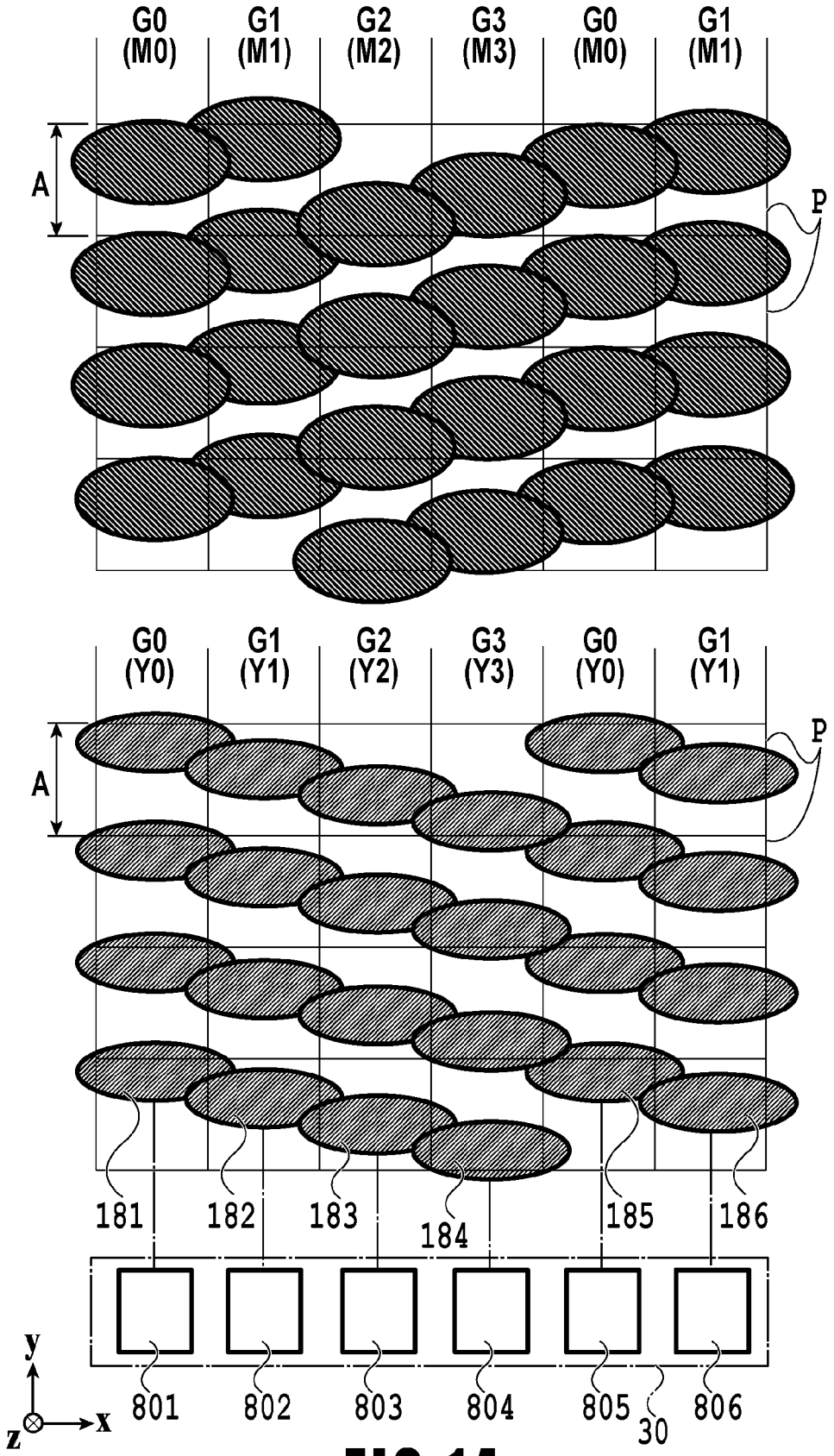
FIG. 14 is an explanatory diagram of the arrangement of colored portions caused to develop colors by the heating pulses in FIG. 13.

FIG. 14 is an explanatory diagram of colored portions in the print medium 10 caused to develop colors by applying the heating pulses in FIG. 13 to the heat generation elements 801 to 806 of the print head 30. In FIG. 14, only magenta (M) and yellow (Y) colored portions are illustrated.

The timing of developing magenta (M) at each of the pixel lines 181 to 186 is set on the basis of heating pulses in FIG. 13 as below. Specifically, the color development timing at the pixel line 181 is p1 and p2, the color development timing at the pixel line 182 is p0 and p1, and the color development timing at the pixel line 183 is p5 and p6. Also, the color development timing at the pixel line 184 is p4 and p5, the color development timing at the pixel line 185 is p1 and p2, and the color development timing at the pixel line 186 is p0 and p1. As a result, as illustrated in FIG. 14, the arrangement of the magenta (M) colored portions has a directionality toward the upper right side in the diagram.

The timing of generating yellow (Y) at each of the pixel lines 181 to 186 is set as below. Specifically, the color development timing at the pixel line 181 is p0, the color development timing at the pixel line 182 is p2, and the color development timing at the pixel line 183 is p4. Also, the color development timing at the pixel line 184 is p6, the color development timing at the pixel line 185 is p0, and the color development timing at the pixel line 186 is p2. As a result, as illustrated in FIG. 14, the arrangement of the yellow (Y) colored portions has a directionality toward the lower right side in the diagram.

Thus, the directionality of arrangement of magenta colored portions and the directionality of arrangement of yellow colored portions are different. Hence, even in a case where these colored portions are slightly displaced from each other in the print medium 10, the coloration of the printed image is not greatly changed. Then, an image with stable coloration is printed even in a case where the color development timings are shifted due to variation in speed of conveyance of the print medium 10, uneven distribution of temperature in the print head, and the like.

To describe the reason why the coloration is stable in the case where the directionalities of arrangement of magenta and yellow colored portions are different, assume a case where the directionalities are the same. Assume, for example, a situation where the directionality of magenta defines a checkered pattern while the directionality of yellow defines a reverse checkered pattern, and the magenta and yellow colored portions are to be disposed over all pixels without the magenta and yellow color development positions displaced. If the arrangements of these colored portions are displaced relative to each other by a one-pulse period vertically or horizontally, all pixels will be red as a secondary color and white as a result of no color development, so that the coloration will be greatly changed. On the other hand, in the case where the directionalities of arrangement of the magenta and yellow colored portions are varied from each other, as in the present embodiment, if these colored portions are slightly displaced relative to each other, all pixels will be formed of magenta, yellow, red, and white in predetermined ratios. These predetermined ratios will not greatly change even if the arrangements of the magenta and yellow colored portions are shifted by a one-pulse period vertically or horizontally. For this reason, the coloration of the printed image is stable in the case where the directionalities of arrangement of magenta and yellow colored portions are varied from each other.

Fifth Embodiment

In the present embodiment, at least some heating pulses are superimposed on each other to improve the printing speed and reduce the amount of heat to be introduced necessary for color development and also to increase the coverage of colored portions and thereby achieve printing of a high-quality image.

Figure 15:
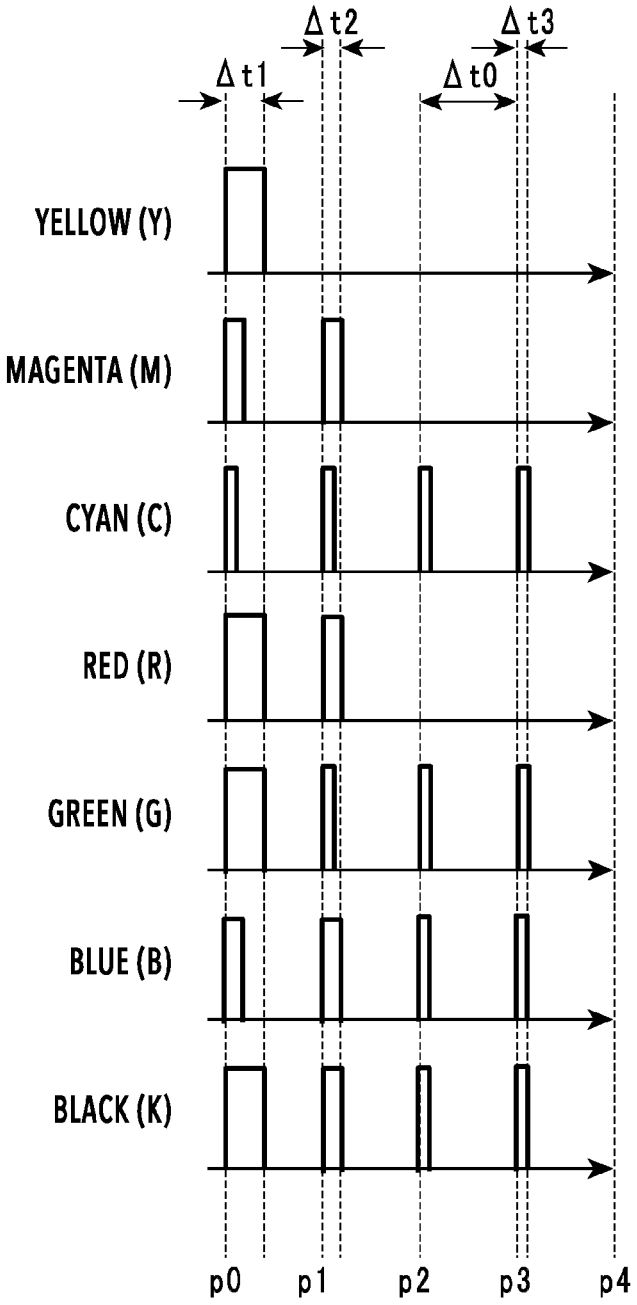
FIG. 15 is an explanatory diagram of heating pulses in a fifth embodiment of the present invention.

FIG. 15 is an explanatory diagram of heating pulses in the present embodiment. In the present example, the heating pulses for yellow (Y), magenta (M), and cyan (C) are superimposed on each other. In FIG. 15, Δt0, Δt1, Δt2, and Δt3 are similar to those in the foregoing embodiments. The development of the single colors of yellow (Y), magenta (M), and cyan (C) is also similar to that in the foregoing embodiments. In the present embodiment, superimposing the heating pulses improves the degree of development of red (R), green (G), and blue (B), which are secondary colors, and of black (K), which is a tertiary color, as described below.

First, a case of developing red (R) will described. In this case, heating pulses for yellow (Y) and magenta (M) are superimposed. In FIG. 15, the heating pulse at the point p0 contributes to the development of the yellow (Y) component. In the comparative example of FIG. 23, the heating pulse at the point p0 contributes to the development of the yellow (Y) component. The degrees of development of these yellow (Y) components are equal. Further, in FIG. 15, the heating pulses at the points p0 and p1 contribute to the development of the magenta (M) component. On the other hand, in FIG. 23, the heating pulses at the points p1 and p2 contribute to the development of the magenta (M) component in red (R). In a comparison of the heating pulses contributing to the magenta (M) component in the above two cases, the pulse width is larger in the former case than in the latter case by (Δt1-Δt2). Thus, the degree of development of the magenta (M) component in FIG. 15 is accordingly better than the degree of development of the magenta (M) component in FIG. 23. Hence, the degree of development of red (R) in the present embodiment is higher than the degree of development of red (R) in the comparative example.

Next, a case of developing green (G) will described. In this case, heating pulses for yellow (Y) and cyan (C) are superimposed. In FIG. 15, the heating pulse at the point p0 contributes to the development of the yellow (Y) component. In the comparative example of FIG. 23, the heating pulse at the point p0 contributes to the development of the yellow (Y) component. The degrees of development of these yellow (Y) components are equal. Further, in FIG. 15, the heating pulses at the points p0 to p3 contribute to the development of the cyan (C) component. On the other hand, in FIG. 23, the heating pulses at the points p3 to p6 contribute to the development of the cyan (C) component. In a comparison of the heating pulses contributing to the cyan (C) component in the above two cases, the pulse width is larger in the former case than in the latter case by (Δt1-Δt3). Thus, the degree of development of the cyan (C) component in FIG. 15 is accordingly better than the degree of development of the cyan (C) component in FIG. 23. Hence, the degree of development of green (G) in the present embodiment is higher than the degree of development of green (G) in the comparative example.

Next, a case of developing blue (B) will described. In this case, heating pulses for magenta (M) and cyan (C) are superimposed. In FIG. 15, the heating pulses at the points p0 and p1 contribute to the development of the magenta (M) component. On the other hand, in the comparative example of FIG. 23, the heating pulses at the points p1 and p2 contribute to the development of the magenta (M) component. The degrees of development of these magenta (M) components are equal. Further, in FIG. 15, the heating pulses at the points p0 to p3 contribute to the development of the cyan (C) component. On the other hand, in FIG. 23, the heating pulses at the points p3 to p6 contribute to the development of the cyan (C) component. In a comparison of the heating pulses contributing to the cyan (C) component in the above two cases, the pulse width is larger in the former case than in the latter case by $\{(\Delta t2-\Delta t3)\times 2\}$. Thus, the degree of development of the cyan (C) component in FIG. 15 is accordingly better than the degree of development of the cyan (C) component in FIG. 23. Hence, the degree of development of blue (B) in the present embodiment is higher than the degree of development of blue (B) in the comparative example.

Next, a case of developing black (K) will described. In this case, heating pulses for yellow (Y), magenta (M), and cyan (C) are superimposed. In FIG. 15, the heating pulse at the point p0 contributes to the development of the yellow (Y) component. In the comparative example of FIG. 23, the heating pulse at the point p0 contributes to the development of the yellow (Y) component. The degrees of development of these yellow (Y) components are equal. Further, in FIG. 15, the heating pulses at the points p0 and p1 contribute to the development of the magenta (M) component. On the other hand, in FIG. 23, the heating pulses at the points p1 and p2 contribute to the development of the magenta (M) component. In a comparison of the heating pulses contributing to the magenta (M) component in the above two cases, the pulse width is larger in the former case than in the latter case by $(\Delta t1-\Delta t2)$. Thus, the degree of development of the magenta (M) component in FIG. 15 is accordingly better than the degree of development of the magenta (M) component in FIG. 23. Furthermore, in FIG. 15, the heating pulses at the points p0 to p3 contribute to the development of the cyan (C) component. On the other hand, in FIG. 23, the heating pulses at the points p3 to p6 contribute to the development of the cyan (C) component. In a comparison of the heating pulses contributing to the cyan (C) component in the above two cases, the pulse width is larger in the former case than in the latter case by $\{(\Delta t1+\Delta t2)-(2\times\Delta t3)\}$. Thus, the degree of development of the cyan (C) component in FIG. 15 is accordingly better than the degree of development of the cyan (C) component in FIG. 23. Hence, the degree of development of black (K) in the present embodiment is higher than the degree of development of black (K) in the comparative example.

The table below represents the relations between the above developed colors R, G, B, and K and the numbers of heating pulses with the heating times Δt1, Δt2, and Δt3 in the comparative example in FIG. 23 and the embodiment of the present invention in FIG. 17. Each number in parentheses indicates the change in number of heating pulses.

TABLE 1

| | Comparative Example | | | Present Embodiment | | |
|---|---|---|---|---|---|---|
| | Δt1 | Δt2 | Δt3 | Δt1 | Δt2 | Δt3 |
| Red (R) | 1 | 2 | 0 | 1 | 1(−1) | 0 |
| Green (G) | 1 | 0 | 4 | 1 | 0 | 3(−1) |
| Blue (B) | 0 | 2 | 4 | 0 | 2 | 2(−2) |
| Black (K) | 1 | 2 | 4 | 1 | 1(−1) | 2(−2) |

In the present embodiment, since the number of heating pulses is reduced as described above, the printing speed is increased and the peak value of introduced electric power is lowered.

Figure 16:
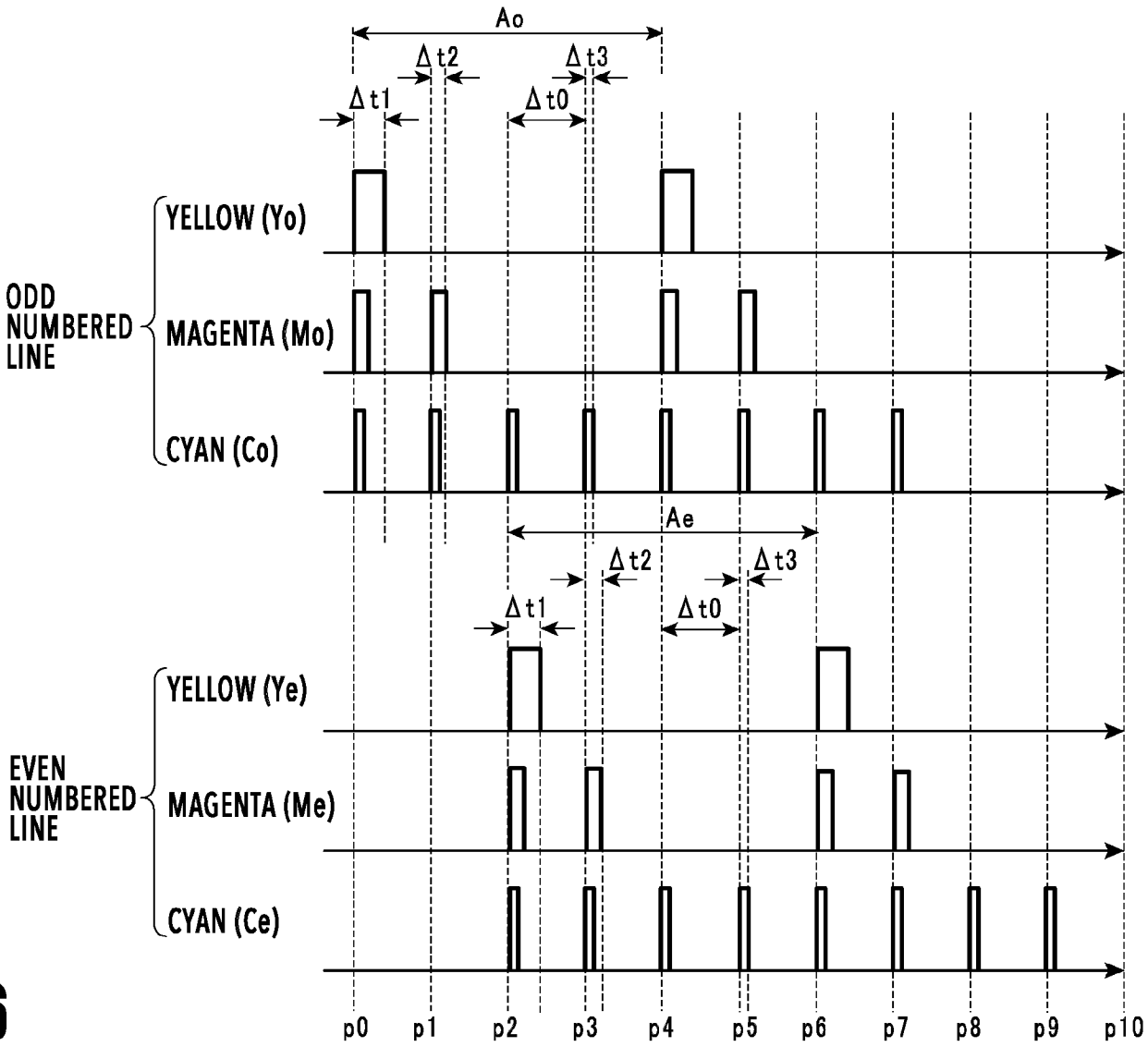
FIG. 16 is an explanatory diagram of heating pulses in the fifth embodiment of the present invention.

FIG. 16 is an explanatory diagram of a case where heating pulses are superimposed as described above, thereby reducing the number of heating pulses applied, and also the timings of application of the heating pulses to the heat generation elements at the odd numbered positions (Yo, Mo, and Co) and the heat generation elements at the even numbered positions (Ye, Me, and Ce) are shifted from each other. In the present example, the heat generation elements at the odd and even numbered positions are repetitively driven at periodic intervals of Ao and Ae, respectively, each of which is equal to a four-pulse period, and the timings of application of heating pulses to the heat generation elements at the odd and even numbered positions are shifted from each other by a half pixel (2/4 pulse period).

Figure 17:
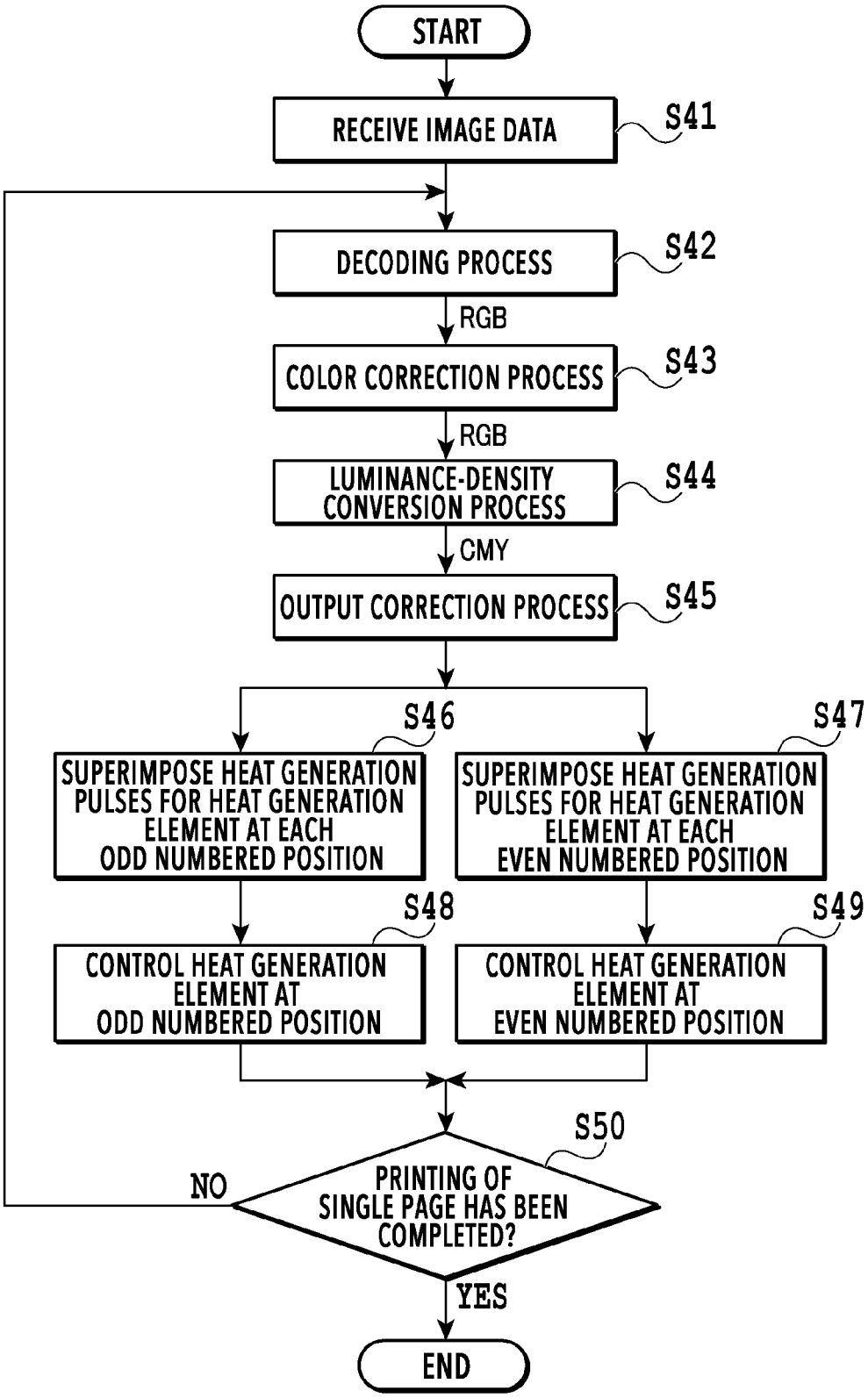
FIG. 17 is a flowchart for explaining image processing in the fifth embodiment of the present invention.

FIG. 17 is a flowchart of image processing for implementing a print operation based on the heating pulses in the present embodiment. The processing in FIG. 17 corresponds to the print job execution process in S15 of FIG. 2B and is executed by the CPU 401 or the image processing accelerator 406 of the printing apparatus 40 (see FIG. 2A). S41 to S45 in FIG. 17 are the same as S21 to S25 in FIG. 7 and description thereof is therefore omitted.

In S46, the CPU 401 or the image processing accelerator 406 superimposes heating pulses for the heat generation element at each odd numbered position. As a result, the pulse width of the heating pulse at the point p0 is at least one of the pulse widths yo, mo, and co and at most the sum of the pulse widths yo, mo, and co. Further, the pulse width of the heating pulse at the point p1 is at least one of the pulse widths mo and co and at most the sum of the pulse widths mo and co. Furthermore, the pulse width of the heating pulses at the points p2 and p3 is the pulse width co. In S47, in parallel with this process in S46, the CPU 401 or the image processing accelerator 406 superimposes heating pulses for the heat generation element at each even numbered position. As a result, the pulse width of the heating pulse at the point p2 is at least one of the pulse widths ye, me, and ce and at most the sum of the pulse widths ye, me, and ce. Further, the pulse width of the heating pulse at the point p3 is at least one of the pulse widths me and ce and at most the sum of the pulse widths me and ce. Furthermore, the pulse width of the heating pulses at the points p4 and p5 is the pulse width ce.

Among the pulse widths y, m, and c, generated in S45, the pulse widths of the heating pulses to be applied to the heat generation elements at the odd numbered positions are yo, mo, and co, and the pulse widths of the heating pulses to be applied to the heat generation elements at the even numbered positions are ye, me, and ce. In the present example, the pulse width after the heating pulse superimposition is calculated by digital arithmetic processing. However, it is possible to use an electric circuit configured to receive a plurality of heating pulses to be superimposed and output a heating pulse corresponding to the pulse width after the superimposition.

Then, the CPU 401 or the image processing accelerator 406 applies the heating pulses after the above superimposition to the heat generation elements at the odd and even numbered positions (S48 and S49). In the present example, as in FIG. 16, when the third heating pulse for the heat generation element (Co) is applied in the periodic drive interval Ao for the first single pixel (point p2), a heating pulse is applied to the heat generation element (Ye) in the periodic drive interval Ae for the first single pixel. Also, when the third heating pulse for the heat generation element (Ce) is applied in the periodic drive interval Ae for the first single pixel (point p4), a heating pulse is applied to the heat generation element (Yo) in the periodic drive interval Ao for the next single pixel (p4 to p8). For this reason, it is necessary to perform control such that heating pulses are applied to the print head 30 after determining the heating pulses for at least two adjacent pixels in the direction of conveyance (y direction) in advance.

Then, the CPU 401 or the accelerator 406 determines whether the printing of the single page of print medium 10 has been completed (S50), and repeats the processes in S42 to S49 until the printing of the single page is completed. If the printing of the single page is completed, the CPU 401 or the accelerator 406 terminates the process in FIG. 17.

As described above, in the present embodiment, the timings of application of heating pulses to the heat generation elements at the odd and even numbered positions are shifted from each other by a half pixel (2/4 pulse period) to thereby increase the coverage of the colored portions, and also heating pulses are superimposed to enhance the degree of the color development. This enables printing of a higher quality image. Further, since the number of heating pulses to be applied is reduced, the printing speed is increased and the peak value of introduced electric power is lowered.

Sixth Embodiment

In the foregoing fifth embodiment, the timings of application of heating pulses to the heat generation elements divided into a plurality of groups as in the first embodiment (the heat generation elements at the odd and even numbered positions) are shifted from each other and also heating pulses are superimposed. In a sixth embodiment of the present invention, the drive timings for the heat generation elements at the odd and even numbered positions are varied from each other within a single periodic drive interval for a heat generation element as in the third embodiment and also heating pulses are superimposed.

Figure 18:
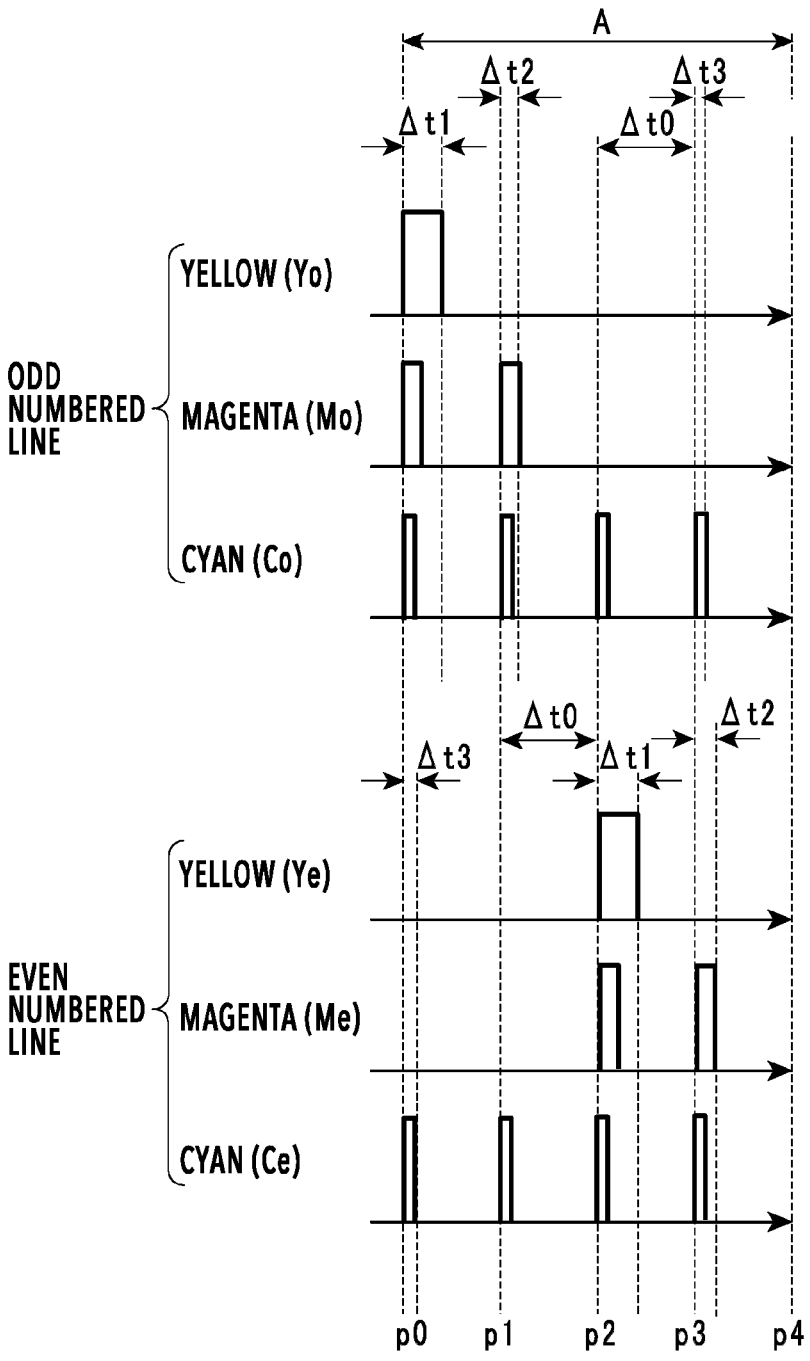
FIG. 18 is an explanatory diagram of heating pulses in a sixth embodiment of the present invention.

FIG. 18 is an explanatory diagram of heating pulses in the present embodiment. As in FIG. 9 in the foregoing third embodiment, the upper three rows in FIG. 18 (Yo, Mo, and Co) represent heating pulses to be applied to the heat generation element (801, 803, or 805) at any odd numbered position. Also, the lower three rows (Ye, Me, and Ce) represent heating pulses to be applied to the heat generation element (802, 804, or 806) at any even numbered position. The yellow (Yo), magenta (Mo), and cyan (Co) heating pulses for the heat generation element at the odd numbered position start being applied at the same point p0. On the other hand, the cyan (Ce) heating pulses for the even numbered heat generation element start being applied at the point p0 while the yellow (Ye) and magenta (Me) heating pulses start being applied at the point p2. Thus, the drive timings for the heat generation elements at the odd and even numbered positions are varied from each other within a single periodic drive interval A for a heat generation element.

As a result, the heat generation element (Ye) is driven with a delay of a half pixel (2/4 pulse period) relative to the heat generation element (Yo), and the heat generation element (Me) is driven with a delay of a half pixel (2/4 pulse period) relative to the heat generation element (Mo). Since the orders of driving of the heat generation elements at the odd and even numbered positions are just shifted from each other as above within a single periodic drive interval A, control to associate a plurality of pixels as in the foregoing first embodiment is not necessary.

Here, there is a difference from the example of FIG. 9 in the foregoing third embodiment in that the heat generation element (Ce) and the heat generation element (Co) are driven with the same timing. However, as is obvious from the comparative of FIG. 25, cyan (C) has sufficient coverage and thus the impact of the difference can be ignored. In a case where one wishes to enhance the degree of development of cyan (C), the drive timings for the heat generation elements at the odd and even numbered positions for cyan (C) may be shifted from each other, as in some foregoing embodiments.

Figure 19:
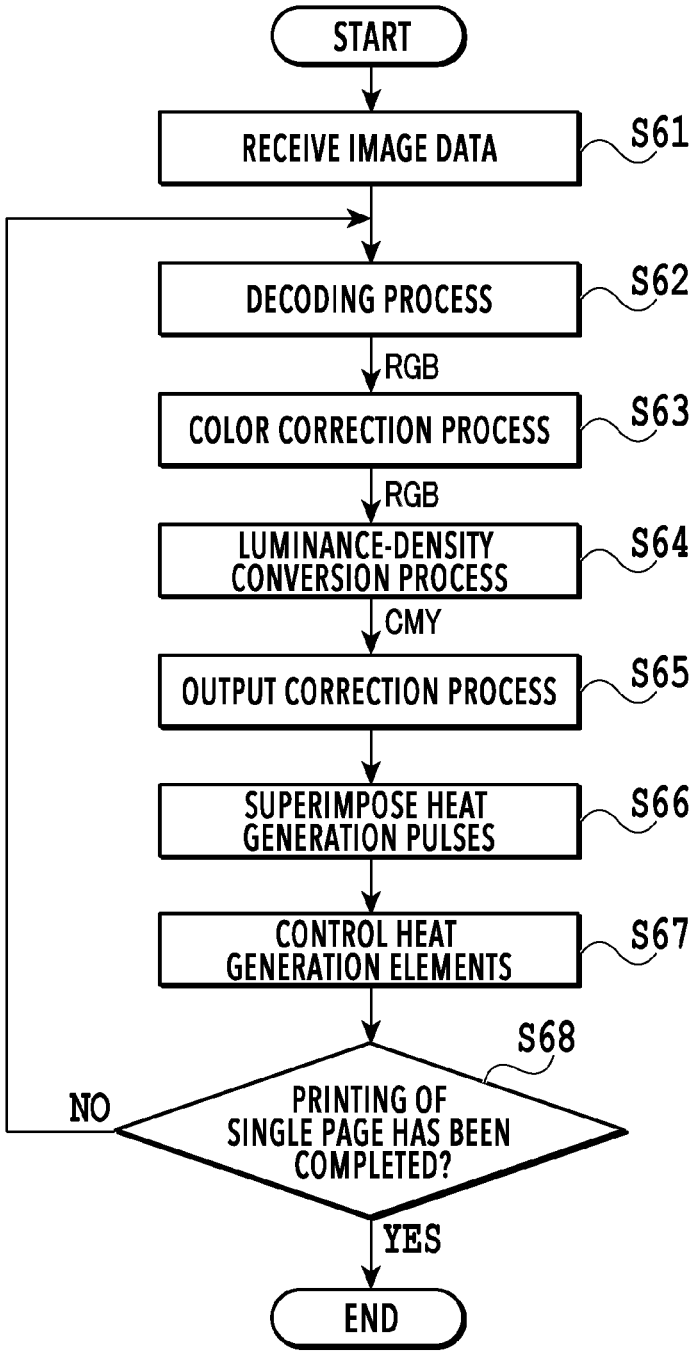
FIG. 19 is a flowchart for explaining image processing in the sixth embodiment of the present invention.

FIG. 19 is a flowchart of image processing for implementing a print operation based on the heating pulses in the present embodiment. The processing in FIG. 19 corresponds to the print job execution process in S15 of FIG. 2B and is executed by the CPU 401 or the image processing accelerator 406 of the printing apparatus 40 (see FIG. 2A). S61 to S65 in FIG. 19 are the same as S21 to S25 in FIG. 7 and description thereof is therefore omitted.

In S66, the CPU 401 or the image processing accelerator 406 superimposes heating pulses for the heat generation element at each odd numbered position and also superimposes heating pulses for the heat generation element at each even numbered position. As a result, the pulse width of the heating pulse for the heat generation element at the odd numbered position at the point p0 is at least one of the pulse widths yo, mo, and co and at most the sum of the pulse widths yo, mo, and co. Further, the pulse width of the heating pulse at the point p1 is at least one of the pulse widths mo and co and at most the sum of the pulse widths mo and co. Furthermore, the pulse width of the heating pulses at the points p2 and p3 is the pulse width co. On the other hand, the pulse width of the heating pulses for the heat generation element at the even numbered position at the points p0 and p1 is ce. The pulse width of the heating pulse at the point p2 is at least one of the pulse widths ye, me, and ce and at most the sum of the pulse widths ye, me, and ce. Further, the pulse width of the heating pulse at the point p3 is at least one of the pulse widths me and ce and at most the sum of the pulse widths me and ce. Among the pulse widths y, m, and c, generated in S65, the pulse widths of the heating pulses to be applied to the heat generation elements at the odd numbered positions are yo, mo, and co, and the pulse widths of the heating pulses to be applied to the heat generation elements at the even numbered positions are ye, me, and ce. In the present example, the pulse width after the heating pulse superimposition is calculated by digital arithmetic processing. However, it is possible to use an electric circuit configured to receive a plurality of heating pulses to be superimposed and output a heat generation pulse corresponding to the pulse width after the superimposition.

Then, the CPU 401 or the image processing accelerator 406 applies the heating pulses after the above superimposition to the heat generation elements at the odd and even numbered positions (S67). Then, the CPU 401 or the accelerator 406 determines whether the printing of the single page of print medium 10 has been completed (S68), and repeats the processes in S62 to S67 until the printing of the single page is completed. If the printing of the single page is completed, the CPU 401 or the accelerator 406 terminates the process in FIG. 19.

As described above, the drive timings for the heat generation elements at the odd and even numbered positions are varied from each other within a single periodic drive interval for a heat generation element, and also heating pulses are superimposed. This eliminates the need for control to associate a plurality of pixels and also enables printing of a higher quality image. Further, since the number of heating pulses to be applied is reduced, the printing speed is increased and the peak value of introduced electric power is lowered.

Seventh Embodiment

The present embodiment is the foregoing sixth embodiment but further involves dividing the plurality of heat generation elements into a number of groups larger than two groups for the heat generation elements at the odd and even numbered positions to control the directionalities of arrangement of colored portions in the print medium.

Figure 20:
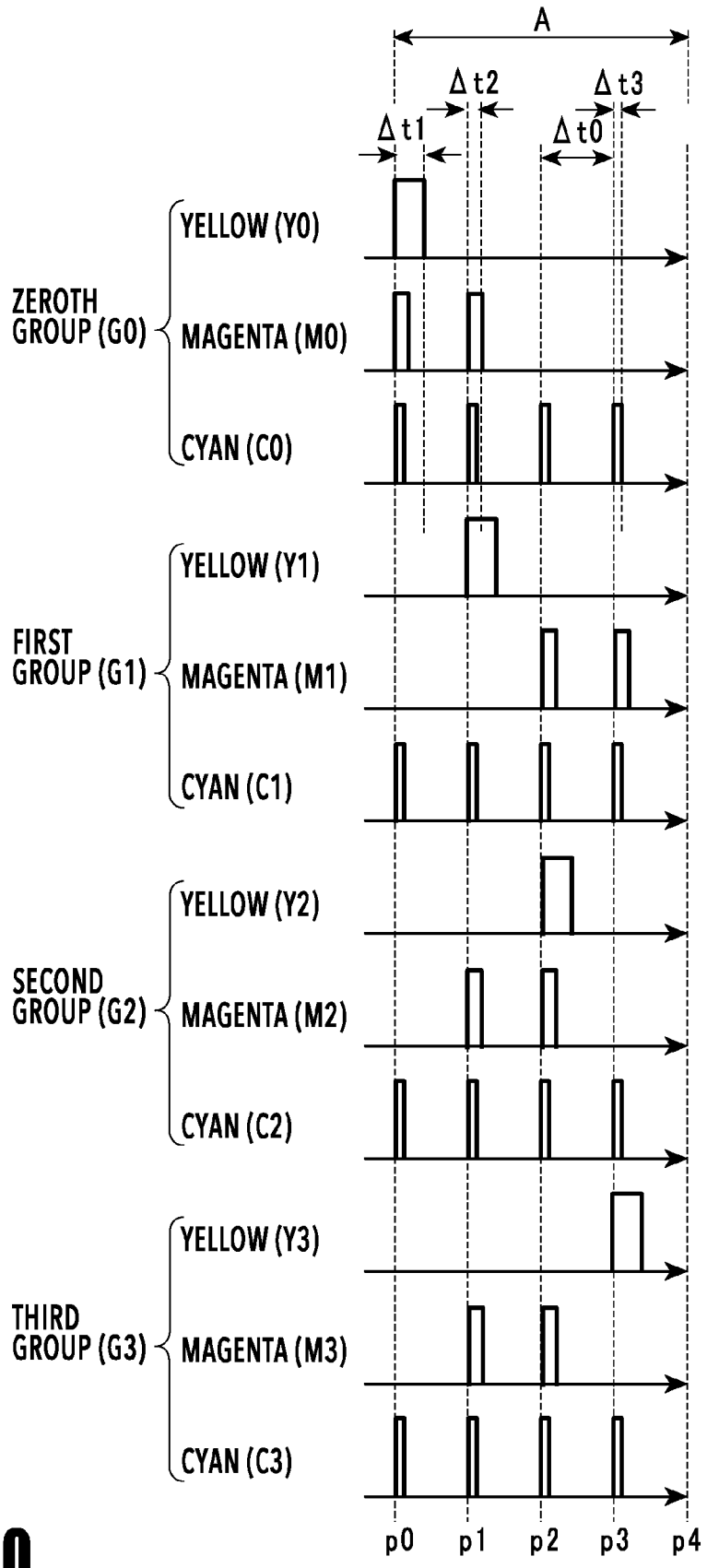
FIG. 20 is an explanatory diagram of heating pulses in a seventh embodiment of the present invention.

FIG. 20 is an explanatory diagram of heating pulses in the present embodiment. In the present example, the plurality of heat generation elements are divided into four, zeroth to third groups G0 to G3, and their drive is controlled. The heating pulses for the heat generation elements in the zeroth group G0 are denoted as Y0, M0, and C0, and the heating pulses for the heat generation elements in group G1 are denoted as Y1, M1, and C1. Similarly, the heating pulses for the heat generation elements in the group G2 are denoted as Y2, M2, and C2, and the heating pulses for the heat generation elements in the group G3 are denoted as Y3, M3, and C3.

The plurality of heat generation elements are divided into four groups as group G0, group G1, group G2, group G3, group G0, . . . along the direction in which they are arranged. Specifically, in the print head 30 in FIG. 3, the heat generation element 801 is classified as the group G0, the heat generation element 802 is classified as the group G1, the heat generation element 803 is classified as the group G2, the heat generation element 804 is classified as the group G3, the heat generation element 805 is classified as the group G0, and the heat generation element 806 is classified as the group G1.

Figure 21:
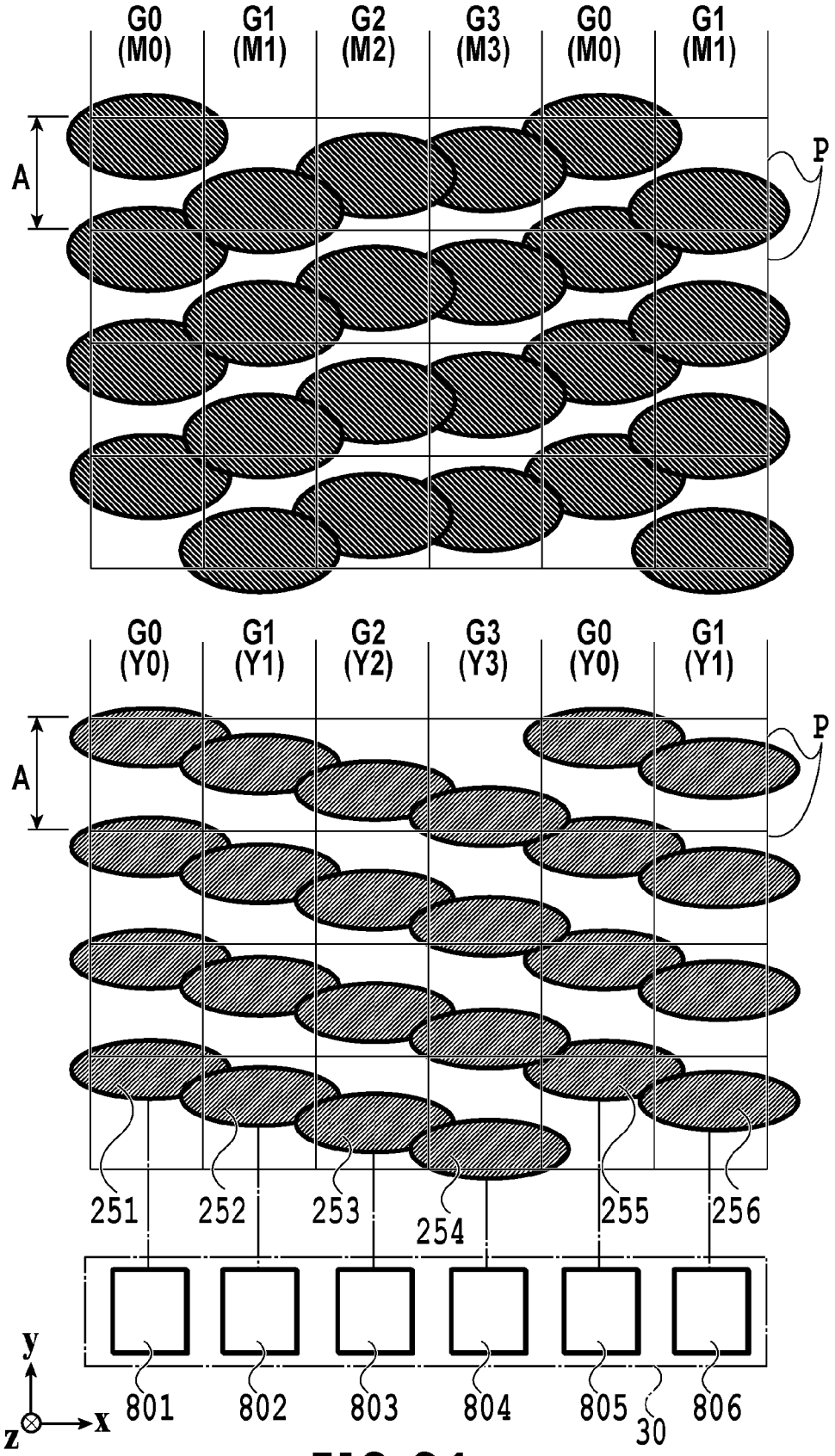
FIG. 21 is an explanatory diagram of the arrangement of colored portions caused to develop colors by the heating pulses in FIG. 20.

FIG. 21 is an explanatory diagram of colored portions in the print medium 10 caused to develop colors by applying the heating pulses in FIG. 20 to the heat generation elements 801 to 806 of the print head 30. In FIG. 21, only magenta (M) and yellow (Y) colored portions are illustrated.

The timing of development of magenta (M) at each of pixel lines 251 to 266 is set on the basis of heating pulses in FIG. 20 as below. Specifically, the color development timing at the pixel line 251 is p0 and p1, the color development timing at the pixel line 252 is p2 and p3, and the color development timing at the pixel line 253 is p1 and p2. Also, the color development timing at the pixel line 254 is p1 and p2, the color development timing at the pixel line 255 is p0 and p1, and the color development timing at the pixel line 256 is p2 and p3. As a result, as illustrated in FIG. 21, the arrangement of the magenta (M) colored portions has a directionality toward the upper right side in the diagram.

The timing of development of yellow (Y) at each of the pixel lines 251 to 256 is set as below. Specifically, the color development timing at the pixel line 251 is p0, the color development timing at the pixel line 252 is p1, and the color development timing at the pixel line 253 is p2. Also, the color development timing at the pixel line 254 is p3, the color development timing at the pixel line 255 is p0, and the color development timing at the pixel line 256 is p1. As a result, as illustrated in FIG. 21, the arrangement of the yellow (Y) colored portions has a directionality toward the lower right side in the diagram.

Thus, the directionality of arrangement of magenta colored portions and the directionality of arrangement of yellow colored portions are different. Hence, even in a case where these colored portions are slightly displaced from each other in the print medium 10, the coloration of the printed image is not greatly changed. Then, an image with stable coloration is printed even in a case where the color development timings are shifted due to variation in speed of conveyance of the print medium 10, uneven distribution of temperature in the print head, and the like.

Moreover, as is obvious from FIG. 20, the heating pulse superimposition increases the degree of freedom in the setting of the application timings (color development timings) for the yellow and magenta heating pulses. For example, as for the magenta heating pulses, the color development timings may be changed from FIG. 20 such that the color development timings at all pixel lines 251 to 256 are p0 and p1. In this way, the directionality of arrangement of yellow colored portions can also be set separately and independently.

Also, the arrangement of magenta colored portions may have a directionality with three-pixel intervals and the arrangement of yellow colored portions may have a directionality with four-pixel intervals, for example. Alternatively, the arrangement of magenta colored portions may have a directionality with three-pixel intervals toward the upper right side and the arrangement of yellow colored portions may have a directionality with six-pixel intervals toward the upper right side. As described above, with heating pulse superimposition, the application timings for heating pulses can be controlled in various manners. Without heating pulse superimposition, the application timing for each heating pulse need to be set exclusively in relation to the others. Hence, the application timings cannot be set freely as in the present example.

As described above, the heating pulses are superimposed on each other, and also the plurality of heat generation elements are divided into a number of groups larger than two groups for the heat generation elements at the odd and even numbered positions, to control the directionalities of arrangement of colored portions in a print medium. In this way, the robustness against displacement of colored portions can be improved.

Eighth Embodiment

Figure 22:
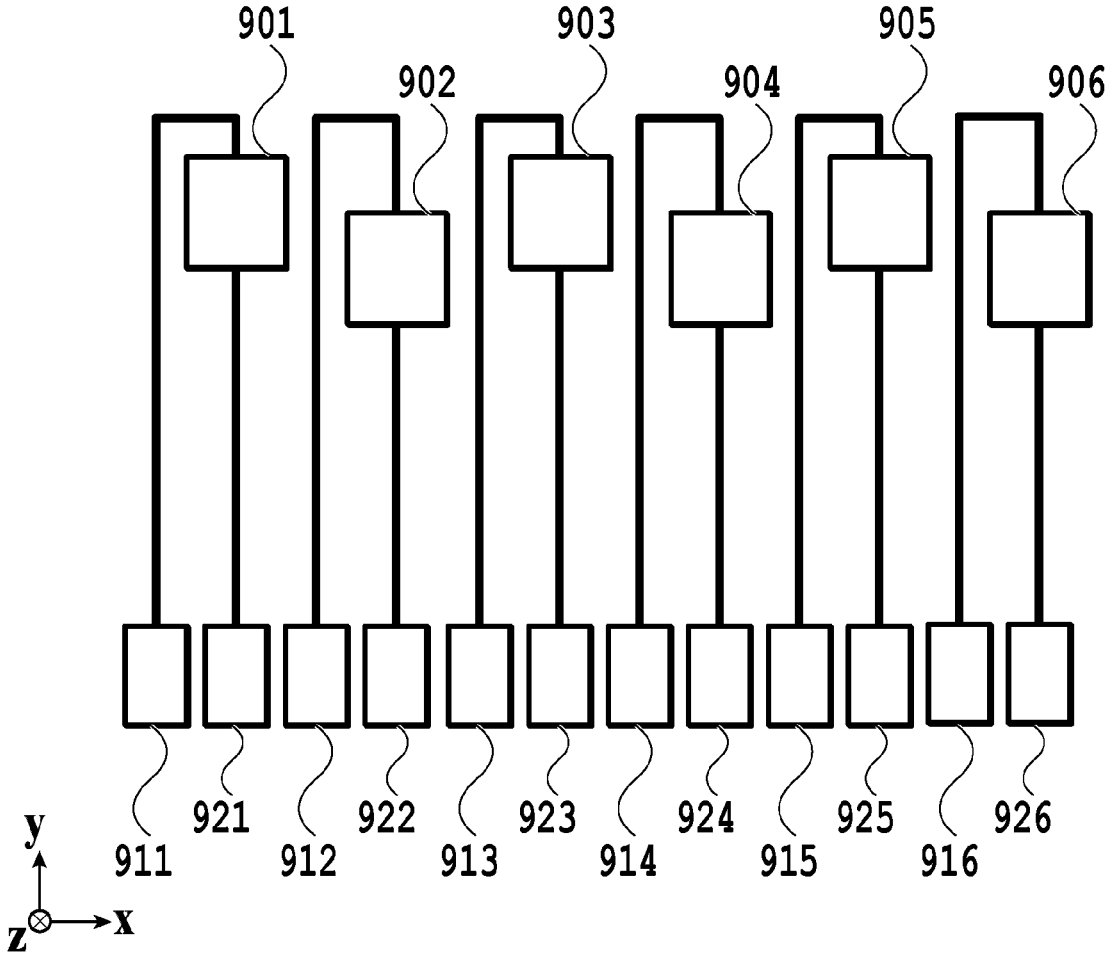
FIG. 22 is an explanatory diagram of the arrangement of heat generation elements in an eighth embodiment of the present invention.

In the foregoing first to seventh embodiments, a print head is used in which heat generation elements are disposed in a straight line as in FIG. 3. In an eighth embodiment of the present invention, a print head 30 is used in which, as in FIG. 22, heat generation elements 901 to 906 are shifted from one another in the direction of conveyance of the print medium 10 (y direction). To the heat generation elements 901 to 906 are connected positive electrodes 911 to 916 and negative electrodes 921 to 926 that supply electric power to them, respectively.

The heat generation elements for the even numbered pixel lines (the heat generation elements at the even numbered positions) 902, 904, and 906 are disposed at positions shifted from the heat generation elements for the odd numbered pixel lines (the heat generation elements at the odd numbered positions) 901, 903, and 905 by an approximately half pixel toward the upstream side in the direction of conveyance (y direction). Thus, colored portions equivalent to those in the foregoing first embodiment are formed by applying the heating pulses in the comparative example of FIG. 23 to these heat generation elements 901 to 906. In other words, an advantageous effect similar to that in the first embodiment is obtained by setting the positional shift between the heat generation elements at the even and odd numbered positions in FIG. 22 to a value equivalent to the positional shift between the colored portions obtained by applying the heating pulses in the foregoing first embodiment.

As described above, in the present embodiment, the positions at which the plurality of heat generation elements are disposed are changed. This increases the coverage of each colored portion and thus enables printing of a high-quality image, as in the foregoing embodiments. Also, as in some foregoing embodiments, heating pulses may be superimposed. This improves the printing speed and reduces the amount of heat to be introduced necessary for color development. Further, as in some foregoing embodiments, the plurality of heat generation elements may be divided into a number of groups to control the directionalities of arrangement of colored portions in the print medium. In this way, the robustness against displacement of colored portions can be improved.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-133533, filed Jul. 13, 2018, which is hereby incorporated by reference wherein in its entirety.

What is claimed is:

1. A printing apparatus comprising:

a conveyance unit configured to convey a print medium in a first direction;

a print head including a plurality of heat generation elements that are arranged in a second direction crossing the first direction and heat the print medium, the print medium having a plurality of color development layers that develop colors to obtain colored portions by being heated, the plurality of color development layers being formed at different positions in a thickness direction of the print medium, the plurality of color development layers including a first color development layer that develops a first color and second color development layer that develops a second color different from the first color; and a control unit configured to control the heat generation elements on a basis of heating pulses so as to selectively cause the plurality of color development layers to develop the respective colors, the control unit controlling heating positions on the print medium to be heated by the plurality of heat generation elements such that:

(i) in at least one of the color development layers in the print medium, lines, each including a plurality of the colored portions arranged in the second direction, are arranged at a predetermined resolution in the first direction and positions of the plurality of the colored portions are shifted between the lines in the first direction by a distance smaller than an interval corresponding to the resolution;

(ii) in the first color development layer, in a case where a first colored portion and colored portions adjacent to both sides of the first colored portion in the second direction are formed by the heat generation elements, the first colored portion and a colored portion adjacent to and closest to the first colored portion are arranged side by side in a third direction; and (iii) in the second color development layer, in a case where colored portions adjacent to both sides of a second colored portion in the second direction are formed by the heat generation elements, the second colored portion and a colored portion adjacent to and closest to the second colored portion are arranged side by side in a fourth direction different from the third direction, the second colored portion corresponding to a pixel of the first colored portion.

2. The printing apparatus according to claim 1, wherein the plurality of heat generation elements include heat generation elements arranged in the second direction, and the control unit controls the plurality of heat generation elements such that the heating positions on the print medium to be heated by the heat generation elements arranged in the second direction are shifted from each other in the first direction.

3. The printing apparatus according to claim 2, wherein the control unit divides the heat generation elements arranged in the second direction into a plurality of groups including a first group and a second group, and controls the plurality of heat generation elements such that the heating positions on the print medium to be heated by the heat generation elements in the first group and the heating positions on the print medium to be heated by the heat generation elements in the second group are shifted from each other in the first direction.

4. The printing apparatus according to claim 3, wherein the control unit shifts a periodic interval at which the heat generation elements in the first group are caused to generate heat and a periodic interval at which the heat generation elements in the second group are caused to generate heat, from each other.

5. The printing apparatus according to claim 3, wherein the control unit controls the plurality of heat generation elements such that an order of color development of the first color development layer and the second color development layer by the heat generation elements in the first group and an order of color development of the first color development layer and the second color development layer by the heat generation elements in the second group are different from each other.

6. The printing apparatus according to claim 3, wherein the heat generation elements in the first group are heat generation elements arranged at odd numbered positions in the second direction, and the heat generation elements in the second group are heat generation elements arranged at even numbered positions in the second direction.

7. The printing apparatus according to claim 1, wherein the control unit controls the plurality of heat generation elements on a basis of heating pulses obtained by superimposing at least partly a heating pulse for color development of the first color development layer and a heating pulse for color development of the second color development layer.

8. The printing apparatus according to claim 1, wherein the print head includes heat generation elements in a first group and heat generation elements in a second group that are arranged in the second direction such that positions of elements in the first group and positions of elements in the second group are shifted from each other in the first direction.

9. The printing apparatus according to claim 1, wherein the control unit controls the heating positions on the print medium such that:

in the first color development layer, in a case where a first colored portion and colored portions adjacent to both sides of the first colored portion in the second direction are formed by the heat generation elements, the first colored portion and the colored portions adjacent to both sides of the first colored portion are arranged side by side in a third direction; and in the second color development layer, in a case where colored portions adjacent to both sides of a second colored portion in the second direction are formed by the heat generation elements, the second colored portion and the colored portions adjacent to both side of the second colored portion are arranged side by side in a forth direction different from the third direction.

10. The printing apparatus according to claim 1, wherein the control unit controls the heating positions on the print medium such that:

in the first color development layer developed overall by the heat generation elements, colored portion groups, each of which is formed by colored portions arranging in the third direction, are arranged in the second direction with a first interval of pixels; and in the second color development layer developed overall by the heat generation elements, colored portion groups, each of which is formed by colored portions arranging in the fourth direction, are arranged in the second direction with second interval of pixels.

11. The printing apparatus according to claim 10, wherein the first interval is larger than the second interval.

12. The printing apparatus according to claim 1, wherein a size of a colored portion formed in the first color development layer and a size of a colored portion formed in the second color development layer are different.

13. The printing apparatus according to claim 1, wherein the plurality of color development layers include a third color development layer that develops a third color different from the first color and the second color, and wherein the control unit controls the heating positions on the print medium such that in the third color development layer, in a case where colored portions adjacent to both sides of a third colored portion in the second direction are formed by the heat generation elements, the third colored portion and a colored portion adjacent to and closest to the third colored portion are arranged side by side in a fifth direction different from the third direction and the fourth direction, the third colored portion corresponding to the pixel of the first colored portion.

14. The printing apparatus according to claim 13, wherein a size of a colored portion formed in the first color development layer, a size of a colored portion formed in the second color development layer, and a size of a colored portion formed in the third color development layer are different.

15. The printing apparatus according to claim 1, wherein in a case where, the first colored portion and colored portions adjacent to both sides of the first colored portion in the second direction are formed by the heat generation elements in the first color development layer and the second colored portion corresponding to a pixel of the first colored portion and colored portions adjacent to both sides of the second colored portion in the second direction are formed by the heat generation elements in the second color development layer, a slope of line formed by the first colored portion and a colored portion adjacent to and closest to the first colored portion and a slope of line formed by the second colored portion and a colored portion adjacent to and closest to the second colored portion are opposite.

16. A printing method comprising:

a step of conveying a print medium in a first direction, the print medium in having a plurality of color development layers that develop colors by being heated formed at different positions in a thickness direction of the print medium, the plurality of color development layers including a first color development layer that develops a first color and a second color development layer that develops a second color different from the first color; and a step of controlling a plurality of heat generation elements that are arranged in a second direction crossing the first direction to heat the print medium on a basis of heat generation pulses so as to selectively cause the plurality of color development layers to develop the respective colors, wherein, in the controlling step, heating positions on the print medium to be heated by the plurality of heat generation elements are controlled such that:

(i) in at least one of the color development layers in the print medium, lines, each including a plurality of the plurality of colored portions arranged in the second direction, are arranged at a predetermined resolution in the first direction and positions of the plurality of the colored portions are shifted between the lines in the first direction by a distance smaller than an interval corresponding to the resolution, (ii) in the first color development layer, in a case where a first colored portion and colored portions adjacent to both sides of the first colored portion in the second direction are formed by the heat generation elements, the first colored portion and a colored portion adjacent to and closest to the first colored portion are arranged side by side in a third direction; and (iii) in the second color development layer, in a case where colored portions adjacent to both sides of a second colored portion in the second direction are formed by the heat generation elements, the second colored portion and a colored portion adjacent to and closest to the second colored portion are arranged side by side in a fourth direction different from the third direction, the second colored portion corresponding to a pixel of the first colored portion.

17. A non-transitory computer readable storage medium storing a program for causing a computer to perform a printing method, the printing method comprising:

a step of conveying a print medium in a first direction, the print medium in having a plurality of color development layers that develop colors by being heated formed at different positions in a thickness direction of the print medium, the plurality of color development layers including a first color development layer that develops a first color and a second color development layer that develops a second color different from the first color; and a step of controlling a plurality of heat generation elements that are arranged in a second direction crossing the first direction to heat the print medium on a basis of heat generation pulses so as to selectively cause the plurality of color development layers to develop the respective colors, wherein, in the controlling step, heating positions on the print medium to be heated by the plurality of heat generation elements are controlled such that:

(i) in at least one of the color development layers in the print medium, lines, each including a plurality of the plurality of colored portions arranged in the second direction, are arranged at a predetermined resolution in the first direction and positions of the plurality of the colored portions are shifted between the lines in the first direction by a distance smaller than an interval corresponding to the resolution, (ii) in the first color development layer, in a case where a first colored portion and colored portions adjacent to both sides of the first colored portion in the second direction are formed by the heat generation elements, the first colored portion and a colored portion adjacent to and closest to the first colored portion are arranged side by side in a third direction; and (iii) in the second color development layer, in a case where colored portions adjacent to both sides of a second colored portion in the second direction are formed by the heat generation elements, the second colored portion and a colored portion adjacent to and closest to the second colored portion are arranged side by side in a fourth direction different from the third direction, the second colored portion corresponding to a pixel of the first colored portion.

* * * * *